US010750797B2

(12) United States Patent
Yoon et al.

(10) Patent No.: US 10,750,797 B2
(45) Date of Patent: Aug. 25, 2020

(54) DEPLOYABLE SEGMENTED SPORT EQUIPMENT

(71) Applicants: Sebastian Yoon, Calgary (CA); David A. Guerra, Calgary (CA)

(72) Inventors: Sebastian Yoon, Calgary (CA); David A. Guerra, Calgary (CA)

( * ) Notice: Subject to any disclaimer, the term of this patent is extended or adjusted under 35 U.S.C. 154(b) by 0 days.

(21) Appl. No.: 15/381,548

(22) Filed: Dec. 16, 2016

(65) Prior Publication Data

US 2017/0143054 A1 May 25, 2017

Related U.S. Application Data

(63) Continuation-in-part of application No. 14/036,230, filed on Sep. 25, 2013, now Pat. No. 9,545,125, which is a continuation-in-part of application No. 13/850,104, filed on Mar. 25, 2013, now Pat. No. 9,072,330.

(51) Int. Cl.

| | |
|---|---|
| ***A41D 13/015*** | (2006.01) |
| ***A63B 71/10*** | (2006.01) |
| ***A63B 71/12*** | (2006.01) |
| ***A42B 3/06*** | (2006.01) |
| ***A42B 3/12*** | (2006.01) |
| ***A42B 3/04*** | (2006.01) |
| ***A42B 3/32*** | (2006.01) |

(52) U.S. Cl.

CPC ..... *A41D 13/015* (2013.01); *A42B 3/046* (2013.01); *A42B 3/063* (2013.01); *A42B 3/064* (2013.01); *A42B 3/069* (2013.01); *A42B 3/125* (2013.01); *A42B 3/32* (2013.01); *A63B 71/10* (2013.01); *A63B 71/1225* (2013.01); *A63B 2071/125* (2013.01); *A63B 2071/1233* (2013.01); *A63B 2071/1241* (2013.01); *A63B 2071/1258* (2013.01)

(58) Field of Classification Search

CPC ..... A41D 13/015; A42B 3/046; A42B 3/063; A42B 3/064; A42B 3/32; A63B 71/10

USPC ... 2/455, 456, 459, 463, 464, 465, 466, 467, 2/410–18

See application file for complete search history.

(56) References Cited

U.S. PATENT DOCUMENTS 5,357,409 A * 10/1994 Glatt ..... A42B 3/044 362/105

9,072,330 B2 * 7/2015 Yoon ..... A42B 3/069

(Continued)

*Primary Examiner* — Katharine Gracz

*Assistant Examiner* — Brieanna Szafran

(57) ABSTRACT

The present invention is a deployable segmented sport equipment for reducing the impact force on sport equipment worn by a user by using deployable panels. The invention has a body defining a recess, and a panel movable within the recess. The panel includes a panel magnetic element capable of being acted upon by a magnetic force. An electromagnet is provided producing an attractive or repulsive magnetic force on the panel magnetic element. A proximity sensing device capable of sensing an object at a distance from the deployable segmented sport equipment is provided with the body. An electronic controller unit receives signals from the proximity sensing device and controls operation of the controllable magnetic element so as to deploy or retract the panel from or into the recess. The panel being deployed prior to impact with the object, with the repulsive force being controlled to absorb the impact force after impact.

14 Claims, 14 Drawing Sheets

(56) References Cited

U.S. PATENT DOCUMENTS

| | | | | |
|---|---|---|---|---|
| 9,476,478 | B2 * | 10/2016 | Staton | F16F 13/005 |
| 9,545,125 | B2 * | 1/2017 | Yoon | A41D 13/015 |
| 9,706,807 | B2 * | 7/2017 | Abbondanza | A42B 3/20 |
| 2010/0275347 | A1 * | 11/2010 | Baldackin | A42B 3/065 2/411 |
| 2013/0340149 | A1 * | 12/2013 | Richwine | A42B 3/20 2/422 |
| 2014/0215693 | A1 * | 8/2014 | O'Gara | A42B 3/0406 2/410 |
| 2014/0283286 | A1 * | 9/2014 | Yoon | A42B 3/06 2/411 |
| 2015/0052669 | A1 * | 2/2015 | Yoon | A41D 13/015 2/455 |
| 2017/0042273 | A1 * | 2/2017 | Fletcher | A42B 3/20 |
| 2017/0143054 | A1 * | 5/2017 | Yoon | A63B 71/1225 |

* cited by examiner

DEPLOYABLE SEGMENTED SPORT EQUIPMENT

CROSS-REFERENCE TO RELATED APPLICATION

This application is a continuation-in-part under 35 U.S.C. § 120 based upon co-pending U.S. patent application Ser. No. 14/036,230, filed on Sep. 25, 2013. The entire disclosure of the prior application is incorporated herein by reference.

BACKGROUND OF THE INVENTION

Field of the Invention

The present invention relates to a deployable segmented sport equipment for use in connection with reducing the impact force on sport equipment by automatically deploying impact absorbing segments.

Description of the Prior Art

Athletes that participate in contact sports, such as American football and hockey, are subject to exposure to hyperextension, whiplash-type head movement, axial cervical compressive forces, concussion and subarachnoid hemorrhage. Particular athletes and their playing positions are subjected to greater physical contact per play which can force the athletes head rapidly backward to create a whiplash effect or can incur a strong impact, which can result in serious and disabling injury, and even contribute to death.

According to a research by The New York Times released on Sep. 16, 2007, at least 50 high school or younger football players in more than 20 states since 1997 have been killed or have sustained serious head injuries on the field. A further study published in the September $5^{th}$ issue of Neurology, indicated that National Football League (NFL) players may face a higher risk of dying from Alzheimer's disease or amyotrophic lateral sclerosis (ALS). This study links the risk to head injuries, even while wearing a protective helmet authorized by the NFL.

Researchers from the National Institute for Occupational Safety and Health in Cincinnati analyzed 3,439 former NFL players who had spent at least five seasons in the league between 1959 and 1988. Of those players, 334 of them had died. Their causes of death were analyzed by researchers, and it was found that seven had died of Alzheimer's and seven had died of ALS. It was also determined that this is nearly four times higher a rate than that of the general population. Thus resulting in a possible direct link between helmet impacts and increase rate of death.

Outside the link between Alzheimer's disease or ALS and head injuries, another type of injury suffered by football players is a concussion. A concussion is defined as an impact to the head that causes a change in mental status. Changes in mental status include memory problems, dizziness, headaches, confusion, and blurred vision or even loss of consciousness. These symptoms may last a few minutes or many days. Not all people who have concussions lose consciousness.

Although football players wear helmets and other protective equipment, many players still suffer concussions. Over the last 20 years there have been studies that indicate that 15-20% of high school football players (200,000-250,000 players) suffer concussions each year. Researchers at the Sports Medicine Research Laboratory at the University of North Carolina analyzed data from 242 schools and 17,549 football players. They found that 888 players (5.1%) had at least one concussion in a season. Of the 888 players who had one concussion, 131 of them (14.7%) had another concussion the same season.

Even though concussions appear to have decreased in the number and severity over the last few years, the overall number of head injuries is still high. As shown by the Sports Medicine Research Laboratory study, players who have one concussion are approximately three times more likely to have a second concussion the same season than those players who have not had an injury. Head injuries jeopardize not only football players' careers, but their future health.

Several types of impact absorbing equipment, such as helmets, have been developed for athletes participating in severe contact sports wherein the player's helmet includes shock absorbing sections that absorb a percentage of the impact force. However, these systems to do not provide automatically deployable impact absorbing segments, which can be used in combination with proactive repulsion characteristics to reduce the impact force prior to contact with the helmet.

The known impact absorbing helmets are designed to reduce direct impact forces that can mechanically damage an area of contact. Known impact absorbing helmets will typically include padding and a protective shell to reduce the risk of physical head injury. Helmet liners are provided beneath a hardened exterior shell to reduce violent deceleration of the head. These types of protective gear are reasonably effective in preventing injury. Nonetheless, the effectiveness of protective gear remains limited.

Additional known impact absorbing helmets include spring biased sections that are always in an extended or deployed position. Thus leaving the sections extended away from the helmet which increases the chances of damage do the sections, and more importantly increases the chance of injuring a player. A player's hand or fingers may graze across these types of helmets during normal play, whereby a finger may get caught under the extended sections and thus injuring the player's finger or jerking the helmet and injuring the wearer.

While the above-described devices fulfill their respective, particular objectives and requirements, the aforementioned patents do not describe a deployable segmented sport equipment that allows reducing the impact force on sport equipment by automatically deploying impact absorbing segments.

Therefore, a need exists for a new and improved deployable segmented sport equipment that can be used for reducing the impact force on sport equipment by automatically deploying impact absorbing segments. In this regard, the present invention substantially fulfills this need. In this respect, the deployable segmented sport equipment according to the present invention substantially departs from the conventional concepts and designs of the prior art, and in doing so provides an apparatus primarily developed for the purpose of reducing the impact force on sport equipment by automatically deploying impact absorbing segments.

SUMMARY OF THE INVENTION

In view of the foregoing disadvantages inherent in the known types of shock absorbing helmets now present in the prior art, the present invention provides an improved deployable segmented sport equipment, and overcomes the above-mentioned disadvantages and drawbacks of the prior art. As such, the general purpose of the present invention, which will be described subsequently in greater detail, is to provide a new and improved deployable segmented sport equipment and method which has all the advantages of the prior art mentioned heretofore and many novel features that result in a deployable segmented sport equipment which is not anticipated, rendered obvious, suggested, or even implied by the prior art, either alone or in any combination thereof.

To attain this, the present invention essentially comprises a deployable segmented sport equipment for reducing the impact force on sport equipment using deployable segments. The deployable segmented sport equipment has a body defining at least one recess, a panel movable within the recess, at least one controllable magnetic element, and at least one proximity sensing device. The controllable magnetic element can be associated with the recess of the body. The controllable magnetic element can have a configuration capable of producing a magnetic force selected from the group consisting of an attraction force and a repulsion force. The panel can have at least one panel magnetic element having a configuration capable of being acted upon by the magnetic force of the controllable magnetic element. The proximity sensing device can have a configuration capable of sensing an object at a distance from the deployable segmented sport equipment. The controllable magnetic element can have a configuration capable of being operated to deploy the panel prior to impact of the object with the body.

The invention may also include a controller unit having a configuration capable of receiving power from a power source, receiving a signal from the proximity sensing device, and providing a control signal to the controllable magnetic element.

There has thus been outlined, rather broadly, the more important features of the invention in order that the detailed description thereof that follows may be better understood and in order that the present contribution to the art may be better appreciated.

The invention may also include a recess lip and panel flange for guiding and controlling the movement of a portion of the panel in the recess. The recess lip and the panel flange can have a configuration capable of overlapping each other so that the panel flange is able to travel in said recess while the recess lip creates a travel stop for the panel.

Still further, the panel can further include at least one panel recess located on a side of the panel in communication with the recess, with the panel magnetic element extending out from the panel recess.

Even still further, the controllable magnetic element can define a bore having a configuration capable of slidably receiving at least a portion of the panel magnetic element.

The controllable magnetic element can be an electromagnet controllable by the controller unit. The electromagnet can have a configuration capable of producing a variable magnetic field against the panel magnetic element so as to attract or repel the panel magnetic element and thus deploy or retract the panel.

The deployable segmented sport equipment can be worn by a user. The deployable segmented sport equipment can be selected from the group consisting of a helmet, a shoulder protector, an elbow protector, a knee protector, a thigh protector, a hip protector, a shin protector, a wrist protector, an arm protector, a chest protector, a spine protector, a neck protector, a face protector, a torso protector, and an abdomen protector.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. The claims can be regarded as including such equivalent constructions insofar as they do not depart from the spirit and scope of the present invention.

It is therefore an object of the present invention to provide a new and improved deployable segmented sport equipment that has all of the advantages of the prior art impact absorbing helmets and none of the disadvantages.

It is another object of the present invention to provide a new and improved deployable segmented sport equipment that may be easily and efficiently manufactured and marketed.

An even further object of the present invention is to provide a new and improved deployable segmented sport equipment that has a low cost of manufacture with regard to both materials and labor, and which accordingly is then susceptible of low prices of sale to the consuming public, thereby making such deployable segmented sport equipment economically available to the buying public.

Still another object of the present invention is to provide a new deployable segmented sport equipment that provides in the apparatuses and methods of the prior art some of the advantages thereof, while simultaneously overcoming some of the disadvantages normally associated therewith.

Even still another object of the present invention is to provide a deployable segmented sport equipment for reducing the impact force on sport equipment by automatically deploying impact absorbing segments. This allows for absorbing of an impact force by deployable panels prior to actual impact with the body, which can reduce injuries to a user wearing the invention.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
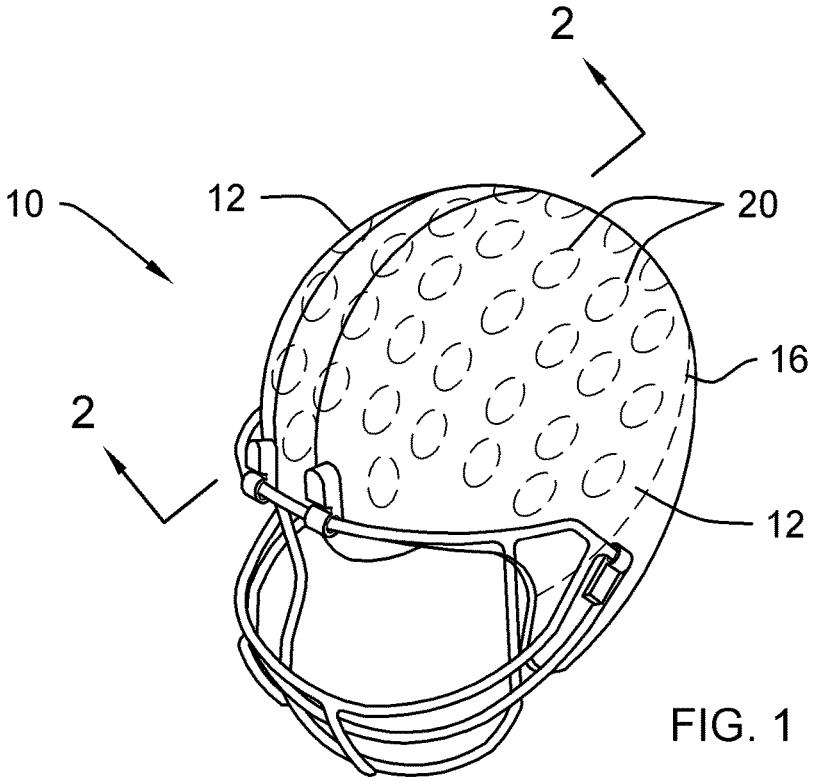
FIG. 1 is a perspective view of an embodiment of a magnetically repulsive sport equipment constructed in accordance with the principles of the present invention, with the phantom lines depicting environmental structure and/or magnetic field.

Referring now to the drawings, and particularly to FIGS. 1-20, an embodiment of the magnetic segmented sport equipment of the present invention is shown and generally designated by the reference numeral 10.

In FIG. 1, a new and improved magnetically repulsive sport equipment 10 of the present invention for reducing the impact force on sport equipment by magnetic repulsion is illustrated and will be described. More particularly, the magnetically repulsive sport equipment 10 can be any sport equipment that receives impact, such as but not limited to, helmets, shoulder protectors, elbow protectors, knee protectors, thigh protectors, hip protectors, shin protectors, wrist protectors, arm protectors, chest protectors, spine protectors, neck protectors, face protectors, torso protectors, and abdomen protectors.

Alternatively, the magnetically repulsive sport equipment 10 can also be sport equipment worn by a player and in combination with sport paraphernalia containing the magnetically repulsive sport equipment, such as but not limited to, baseballs, softballs, bats, hockey pucks, hockey sticks, footballs or polo mallets. The present application will describe, as an example, an embodiment of the present invention as associated with a football helmet 12. However, it can be appreciated that the present invention can be associated with any impact protection equipment. Thus the following exemplary description does not limit the scope of the present invention.

The magnetically repulsive sport equipment 10 can be a helmet 12 that has an outer shell 14, an inner shell or liner assembly 16, and multiple magnetic elements 20 associated with the outer shell 14, inner shell 16 or an area in between the outer and inner shells. The magnetic elements 20 can be associated with an entire or partial surface of the helmet. The magnetic elements 20 are orientated so that each magnetic element 20 has the same pole facing away from the helmet 12. When a second helmet 12' having the same magnetic elements 20' in the same orientation of the first helmet 12 impacts the first helmet 12, the repulsive force produced between the similar poled magnetic elements 20, 20' of the impacting helmets reduces the impact force or deflects the impact. Thus reducing the impact force felt by a person wearing the helmets 12, and reduces the potential of head or neck injury.

The magnetic elements 20 are made from any material that produces a magnetic field or magnetic flux 22 between a north and south pole. However, the magnetic elements 20 may be monopoles, when such technology becomes available. The magnetic field 22 is invisible but produces a force that attracts the opposite pole of other magnets, or repels the same poles of other magnets. The magnetic elements 20 can be made from, but not limited to, ferromagnetic materials, paramagnetic materials or diamagnetic materials. Ferromagnetic and ferromagnetic materials can be, but not limited to, iron, nickel, cobalt, alloys of rare earth metals, lodestone, alnico, ferrite, gadolinium, dysprosium, magnetite, samarium-cobalt, neodymium-iron-boron (NIB), lanthanoid elements, ceramics or curable resins comprising magnetic materials. Paramagnetic materials can be, but not limited to, platinum, aluminum, oxygen or magnetic ferrofluids. Diamagnetic materials are magnets that are repelled by both poles.

Figure 2:
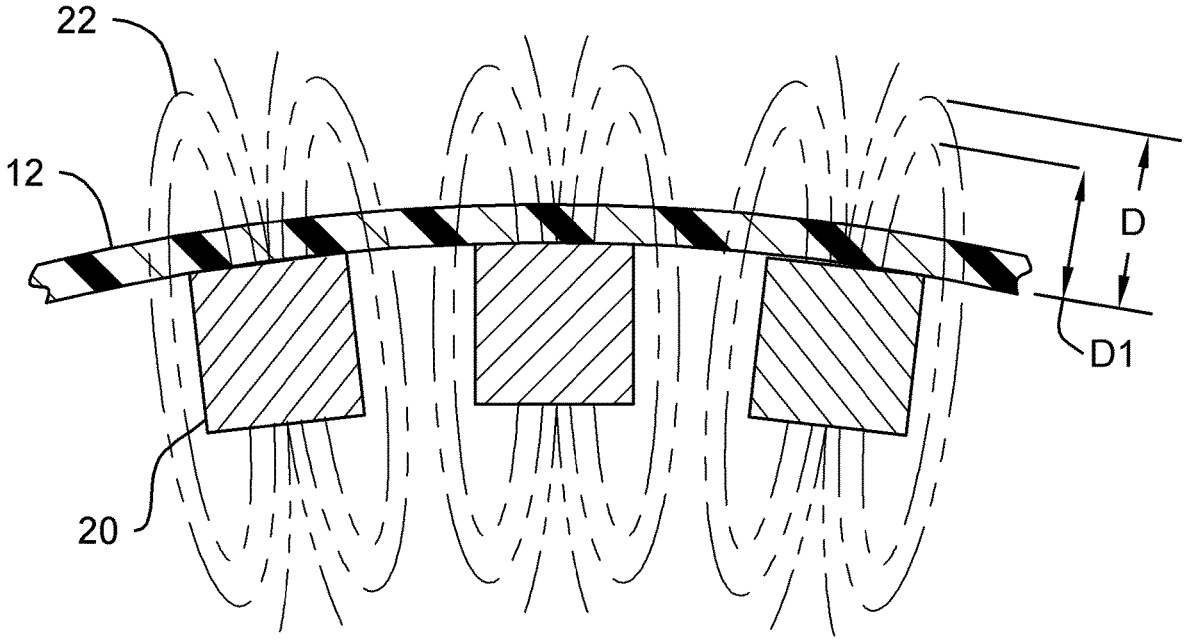
FIG. 2 is a cross-sectional view of a portion of the magnetically repulsive sport equipment of the present invention showing representative magnetic flux lines taken along line 2-2 in FIG. 1.

Each of the magnetic elements 20 produce corresponding magnetic field lines 22, as best illustrated in FIG. 2. The magnetic field lines 22 are substantially contour lines that can be used as a qualitative tool to visualize magnetic forces. For example, in ferromagnetic substances, magnetic force lines 22 can be understood by imagining that the field lines exert a tension, along their length, and a pressure perpendicular to their length on neighboring field lines. Similar poles of the magnet elements 20 of adjacent helmets 12 repel because their field lines 22 do not meet, but run parallel, pushing on each other, thereby producing a repulsive force between the helmets 12. It is known to one skilled in the art that magnetic fields of permanent magnets have no sources or sinks (Gauss's law for magnetism), so their field lines have no start or end: they can only form closed loops, or extend to infinity in both directions.

The magnetic field 22 of each magnetic element 20 will have an attractive or repulsive force that varies from a distance from each pole. The strength of the magnetic field 22 will be less the farther away a magnetic material is from the pole. As illustrated in FIG. 2, each magnetic element 20 produces a corresponding magnetic field force 22 at a distance D from its pole. The magnetic field 22 force is greater at a second distance D1 that is closer to the pole. The outer shell 14 and inner shell 16 of the helmet 12 are typically made from a non-magnetic responsive material, and thus the magnetic fields lines 22 will travel through the outer and inners shells without any deviation in direction or alternation in strength. It can be appreciated that other materials can be associated with the magnetic elements 20, outer shell 14 or inner shell 16 which can control, shield or manipulate the magnetic fields 22 of the magnetic elements 20.

Figure 3:
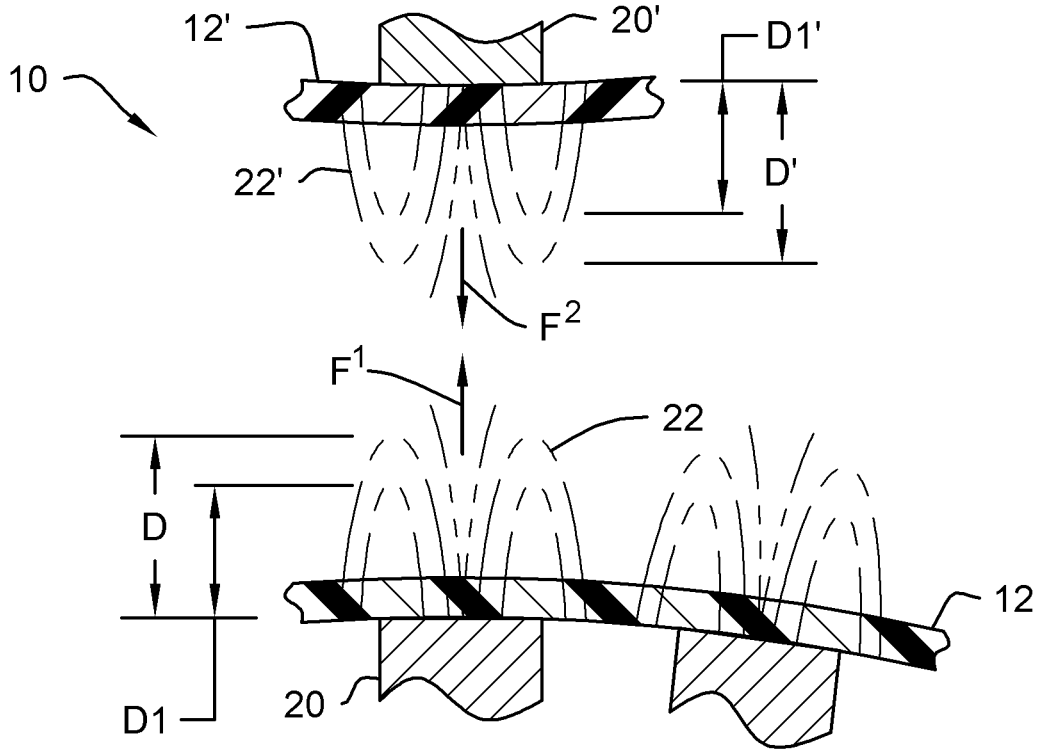
FIG. 3 is a cross-sectional view of a portion of the magnetically repulsive sport equipment of the present invention with force vector lines for a head-on impact.

Referring to FIG. 3, an example of a head-on or direct impact is illustrated. The first helmet 12 produces a repulsive force $F^1$ to a similarly poled second helmet 12' at a distance D, which represents the instant the first magnetic field 22 contacts the second magnetic field 22'. Correspondingly, the second helmet 12' produces a repulsive force $F^2$ to first helmet 12. It can be appreciated that the repulsive forces $F^1$, $F^2$ increase and are interrelated to the distance between the first and second helmets 12, 12'. Thus, the repulsive forces $F^1$, $F^2$ are greater at a distance D1, D1' than at the initial magnetic field contact distance D, D'. The repulsive forces $F^1$, $F^2$ act on both helmets 12, thereby reducing the resultant impact force and reducing potential head or neck injury to wearers of the helmets.

Since the repulsive forces $F^1$, $F^2$ are created at a distance D, D' away from the helmets 12, 12', then the magnetically repulsive sport equipment 10 proactively reduces the resultant impact force prior to impact. The repulsive forces $F^1$, $F^2$ increase in strength as the distance between the impacting helmets 12, 12' gets closer, thus creating a repulsive force that will increasingly reduce the impact force as the distance to impact decreases.

Figure 4:
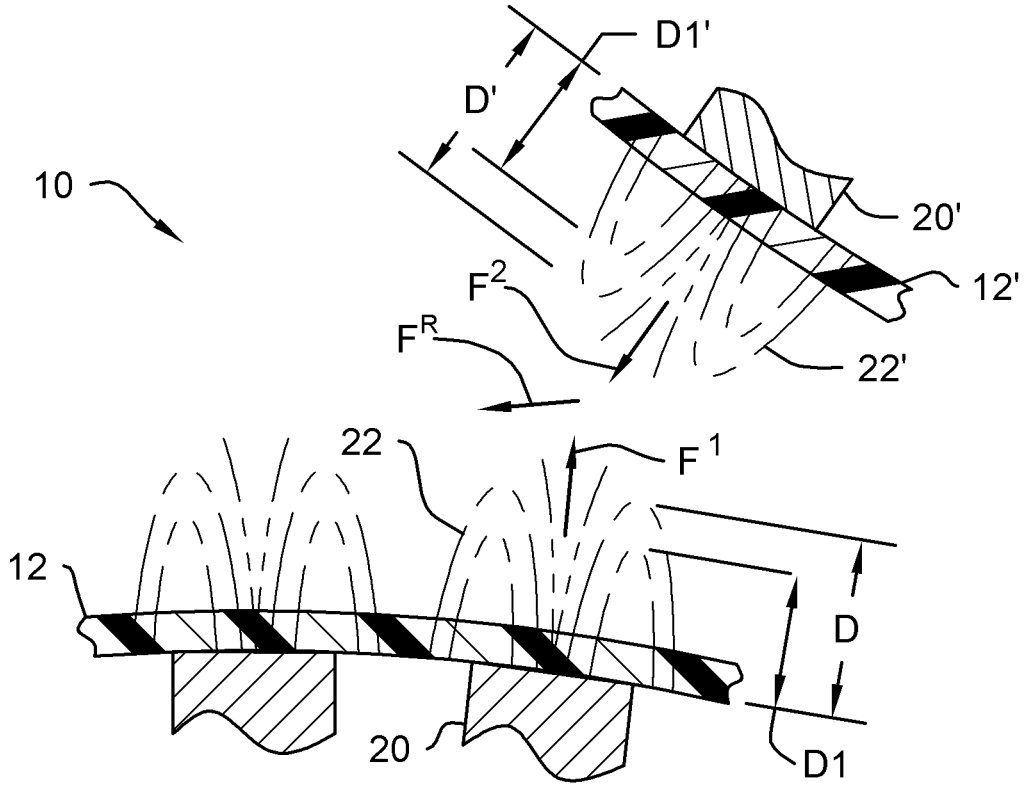
FIG. 4 is a cross-sectional view of a portion of the magnetically repulsive sport equipment of the present invention with force vector lines for an angled impact.

Referring to FIG. 4, an example of an angled impact is illustrated. The first helmet 12 produces a repulsive force $F^1$ to the similarly poled second helmet 12' at a distance D which represents the instant the first magnetic field 22 contacts the second magnetic field 22'. Correspondingly, the second helmet 12' produces a repulsive force $F^2$ to first helmet 12. It can be appreciated that since the repulsive forces $F^1$, $F^2$ are at an angle to each other, then the resultant force vector $F^R$ will be deflected, as per Newton's second law of motion. The deflection of the resultant force vector $F^R$ will increase and change due to the interrelating relationship of the magnetic fields 22, 22' and the distance between the first and second helmets 12, 12'. The resultant force vector $F^R$ translates into a deflection of impact between the first and second helmets 12, 12', thereby reducing the resultant impact force and potential head or neck injury.

The above reduction of impact force between the first and second helmets 12, 12' can be quantified by with the following Equation 1. Equation 1 is valid only for cases in which the effect of fringing is negligible and the volume of the air gap is much smaller than that of the magnetized material:

$$F = \frac{\mu_0 H^2 A}{2} = \frac{B^2 A}{2\mu_0} \qquad \text{Equation 1}$$

where:

A is the area of each surface, in $m^2$;

H is their magnetizing field, in A/m;

$\mu_0$ is the permeability of space, which equals $4\pi\times10^{-7}$ T·m/A; and B is the flux density, in T.

In use with the example illustrated in FIG. 2, and with each magnetic element 20, 20' being two identical cylindrical bar magnets in an end to end configuration representing a head-on impact, Equation 1 is approximately:

$$F = \left[\frac{B_0^2 A^2 (L^2 + R^2)}{\pi\mu_0 L^2}\right]\left[\frac{1}{x^2} + \frac{1}{(x+2L)^2} - \frac{2}{(x+L)^2}\right] \qquad \text{Equation 2}$$

where:

$B_0$ is the magnetic flux density very close to each pole, in T;

A is the area of each pole, in $m^2$;

L is the length of each magnet, in m;

R is the radius of each magnet, in m; and x is the separation between the two magnets, in m.

Equation 3 relates the flux density at the pole to the magnetization of the magnet.

$$B_0 = \frac{\mu_0}{2} M \qquad \text{Equation 3}$$

For two cylindrical magnets 20, 20' with radius R, and height h, with their magnetic dipole aligned, the force can be well approximated (even at distances of the order of h) by:

$$F(x) = \frac{\pi\mu_0}{4} M^2 R^4 \left[\frac{1}{x^2} + \frac{1}{(x+2h)^2} - \frac{2}{(x+h)^2}\right] \qquad \text{Equation 4}$$

Where M is the magnetization of the magnet elements 20, 20' and x is the distance between them. A measurement of the magnetic flux density very close to the magnet $B_0$ is related to M by the formula:

$$B_0 = \mu_0/2 * M \qquad \text{Equation 5}$$

Thus the effective magnetic dipole can be written as:

$$m = MV \qquad \text{Equation 6}$$

Where V is the volume of the magnet, and for this example since the magnets are a cylinder, the volume is $V=\pi R^2 h$.

When h<<x the point dipole approximation is thus obtained by:

$$F(x) = \frac{3\pi\mu_0}{2} M^2 R^4 h^2 \frac{1}{x^4} = \frac{3\mu_0}{2\pi} M^2 V^2 \frac{1}{x^4} = \frac{3\mu_0}{2\pi} m_1 m_2 \frac{1}{x^4} \quad \text{Equation 7}$$

Equation 7 consequently matches the expression of the force between two magnetic dipoles, which is in correlation to the resultant repulsive impact force between impacting helmets 12, 12' in FIGS. 3 and 4.

Figure 5A:
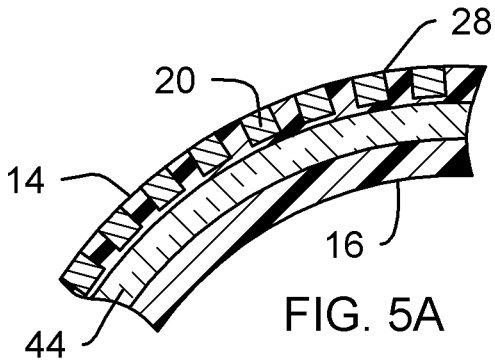
FIGS. 5A-H is a cross-sectional view of a portion of the magnetically repulsive sport equipment of the present invention with alternate embodiment magnetic elements.

Referring to FIGS. 5A-H, alternate embodiment helmets 12 including placements of the magnetic elements 20 and configuration of the inner and outer shells 14, 16 are illustrated. The outer shell 14 of the helmet 12 can include recesses, grooves or notches 28 defined in an exterior surface of the outer shell 14, as best illustrated in FIG. 5A. The magnetic elements 20 are received and securely fitted in the recesses 28 with similar poles facing exterior of the helmet. Positioned between the outer shell 14 and the inner shell 16 can be an impact absorbing material or layer 44. The exterior surface of the outer shell 14 and magnetic elements 20 can be coated or painted. Further padding or linings (not shown) can be adjacent the inner shell 16 interior of the helmet 12.

Figure 5B:
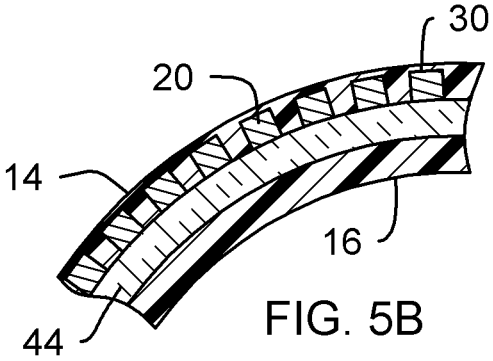

Referring to FIG. 5B, the outer shell 14 of the helmet 12 can include recesses, grooves or notches 30 defined in an interior surface of the outer shell 14. The magnetic elements 20 are received and securely fitted in the recesses 30 with similar poles facing exterior of the helmet. Positioned between the outer shell 14 and the inner shell 16 can be an impact absorbing material or layer 44. Further padding or linings (not shown) can be adjacent the inner shell 16 interior of the helmet 12.

Figure 5C:
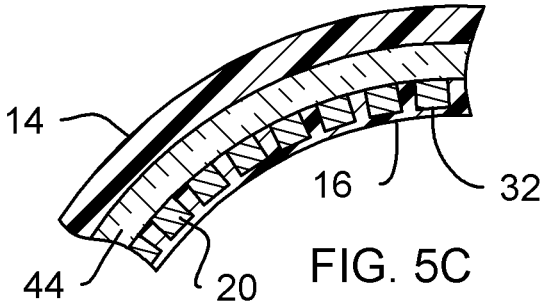

Referring to FIG. 5C, the inner shell 16 of the helmet 12 can include recesses, grooves or notches 32 defined in an exterior surface of the inner shell 16. The magnetic elements 20 are received and securely fitted in the recesses 32 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5D:
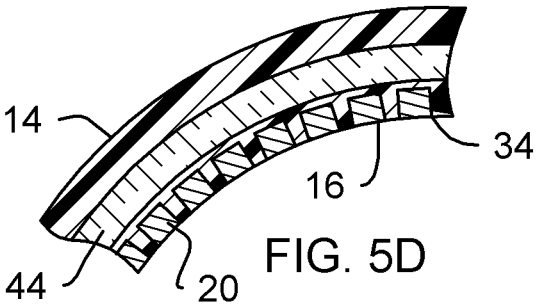

Referring to FIG. 5D, the inner shell 16 of the helmet 12 can include recesses, grooves or notches 34 defined in an interior surface of the inner shell 16. The magnetic elements 20 are received and securely fitted in the recesses 34 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5E:
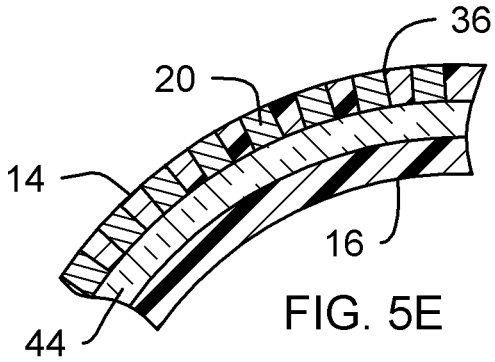

Referring to FIG. 5E, the outer shell 14 of the helmet 12 can include opening, bores or channels 36 defined through the outer shell 14. The magnetic elements 20 are received and securely fitted in the openings 36 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5F:
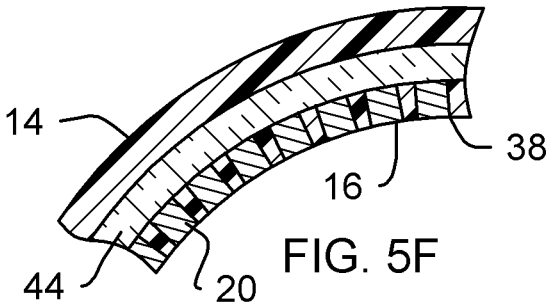

Referring to FIG. 5F, the inner shell 16 of the helmet 12 can include opening, bores or channels 36 defined through the inner shell 16. The magnetic elements 20 are received and securely fitted in the openings 36 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5G:
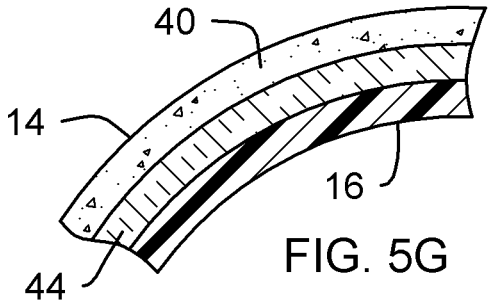

Referring to FIG. 5G, the outer shell 14 of the helmet 12 can be injection molded with magnetic elements or fragments 40 incorporated in a curable resin. Positioned between the outer shell 14 and the inner shell 16 can be the impact absorbing material or layer 44. Further padding or linings (not shown) can be adjacent the inner shell 16 interior of the helmet 12.

Figure 5H:
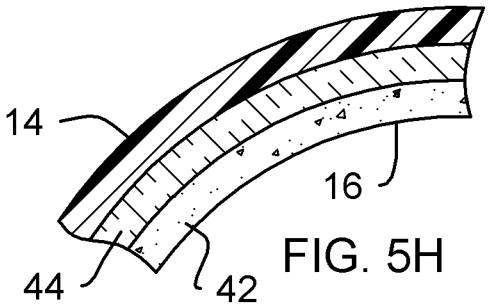

Referring to FIG. 5H, the inner shell 16 of the helmet 12 can be injection molded with magnetic elements or fragments 42 incorporated in a curable resin. Positioned between the outer shell 14 and the inner shell 16 can be the impact absorbing material or layer 44. Further padding or linings (not shown) can be adjacent the inner shell 16 interior of the helmet 12.

It can be appreciated that the exterior or inner surfaces of the outer or inner shells 14, 16 can include a plurality of recess 28, 30, 32, 34 or openings 36, 38 positioned in a variety of locations to maximize the resultant repulsive force. The recess 28, 30, 32, 34 or openings 36, 38 may include means for releasably securing at least one magnetic element 20 therein. Thus providing a user or manufacturer the ability to customize the location of the magnetic elements 20 to produce a predetermine magnetic field 22 map exterior of the helmet 12. Customizing the magnetic field map of the helmet 12 can be beneficial for producing specific helmets for specific player positions that predominately incur impacts at specific locations on the helmets. The means for releasable securing the magnetic elements 20 to the outer or inner shells 14, 16 can be, but not limited to, threaded surfaces, biased latches, adhesives, suction elements or releasable fasteners.

Figure 6:
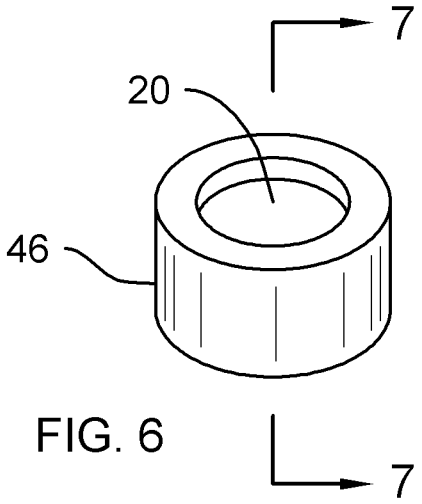
FIG. 6 is a perspective view of the magnetic element in combination with the impact absorbing member of the present invention.
Figure 7:
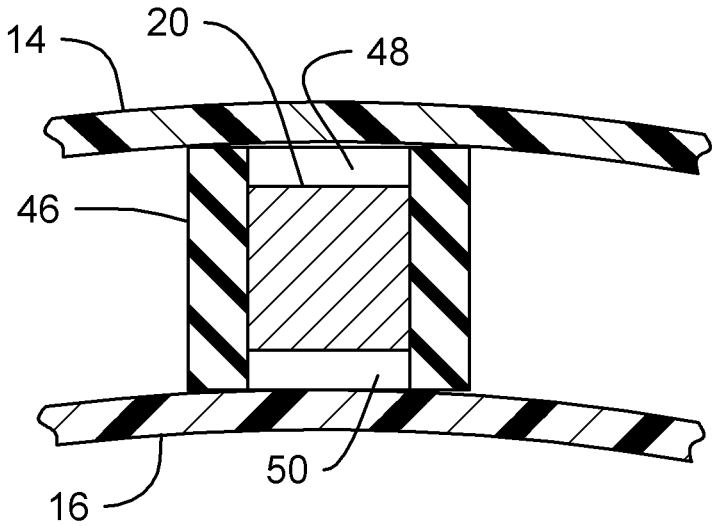
FIG. 7 is a cross-sectional view of the magnetic element and impact absorbing member combination of the present invention taken along line 7-7 in FIG. 6.

Alternatively, as best illustrated in FIGS. 6 and 7, the magnetic elements 20 can be located in an impact absorbing member 46, and placed throughout the helmet 12 between the outer and inner shells 14, 16. It can be appreciated that the impact absorbing member 46 and magnetic element 20 combinations can be in contact with the outer shell 14, inner shell 16 or any combination thereof. The magnetic elements 20 would provide an impact reducing repulsive force prior to impact, while the impact absorbing member 46 would absorb a percentage of the impact force after impact. The impact absorbing member 46 can be made from, but not limited to, rubber, sorbothan, elastomeric materials, foam, impact gel, polymers or laminated materials.

The impact absorbing member 46 can have a means for releasable securing them to the outer shell 14 and/or the inner shell 16 (not shown). The means can be, but not limited to, threaded surfaces, biased latches, adhesives, suction elements or releasable fasteners. Additionally, the magnetic element 20 can be permanently or releasably fitted to the impact absorbing member 46. The impact absorbing member 46 can have any geometry shape and can have means for releasably connecting to additional impact absorbing member to create an array. It can be appreciated that the inner shell 16 can be an adjustable inner lining or strap system.

Figure 8:
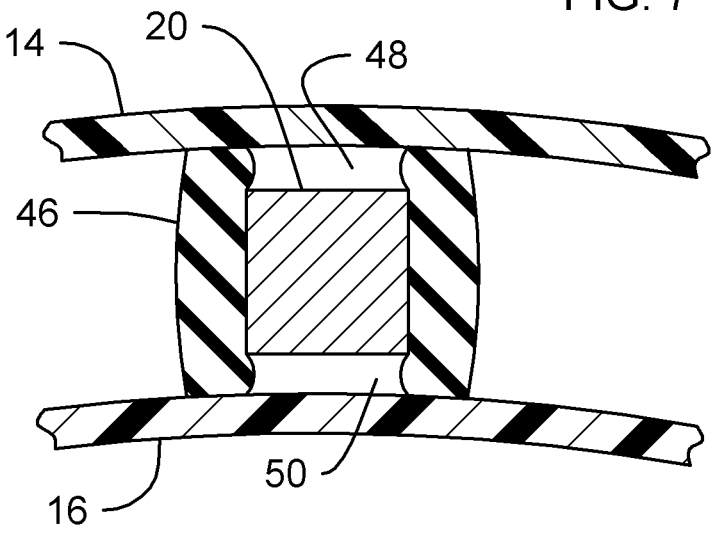
FIG. 8 is a cross-sectional view of the impact absorbing member in a deformed state.

The impact absorbing member 46 can have a height greater than a height of the magnetic element 20 to create an open space, gap or opening 48 adjacent the outer shell 14 and/or an open space, gap or opening 50 adjacent the inner shell 16. The gaps 48, 50 provide space between the outer and inner shells 14, 16 and the magnetic element 20 to prevent direct impact and contact to the magnetic element 20, thereby reducing the chances of damaging the magnetic element 20 and producing splinters that could potentially injure the wearer. It can be appreciated that the magnetic element 20 can be fully encapsulated by the impact absorbing member 46. The gaps 48, 50 are configured to receive a portion of the impact absorbing member 46 that deforms upon impact received by the outer shell 14 and/or the inner shell 16, as best illustrated in FIG. 8.

In use, it can now be understood that the magnetically repulsive sport equipment 10 is used for reducing impact on the human body regarding sport protection equipment, balls, pucks or any combination thereof. A user would don the magnetically repulsive sport equipment, and participate in a sport containing potential impact with another player wearing a magnetically repulsive sport equipment or sport paraphernalia containing the magnetically repulsive sport equipment. Each player or sport paraphernalia would include magnetic elements 20 having similar exteriorly facing poles. Prior to impact, the magnetic fields 22, 22' of potentially impacting magnetic elements 20, 20' would create a repulsive force that will increasingly reduce the impact force as the distance to impact decreases. Thus reducing the impact force received by the wearer of the magnetically repulsive sport equipment 10.

Alternatively, if the potential impact force is directed to the wearer at an angle, then repulsive force produced between the magnetic elements 20, 20' could deflect the impact vector and thereby further reduce the resultant impact force received by the wearer.

Figure 9:
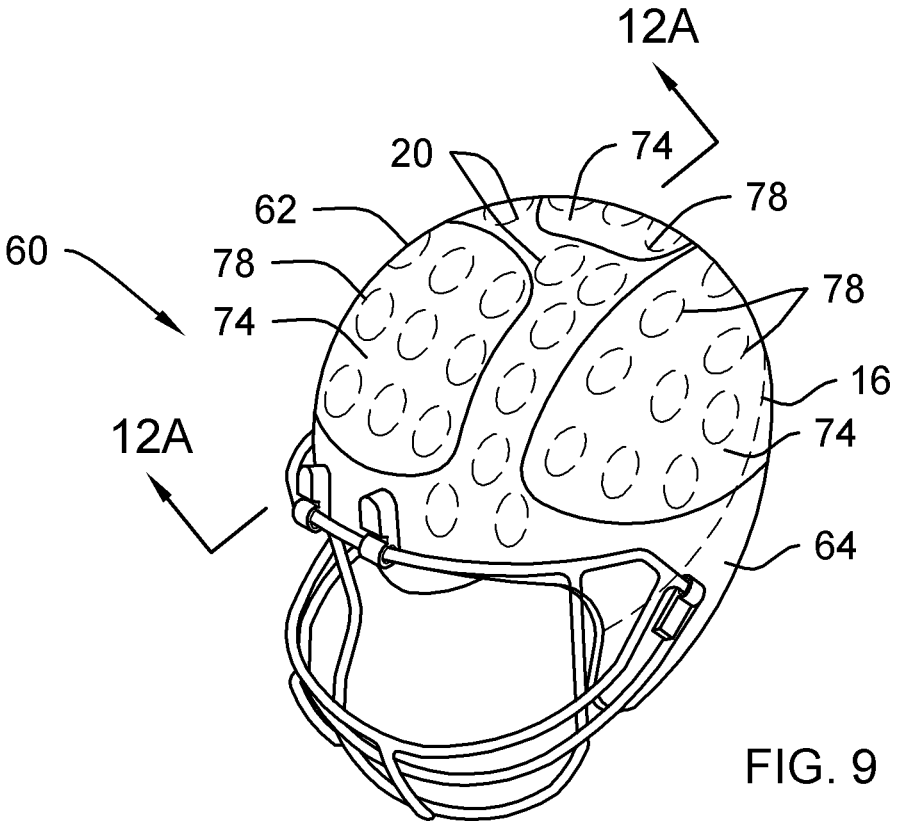
FIG. 9 is a perspective view of an embodiment of the magnetic segmented sport equipment in a pre-deployed position, constructed in accordance with the principles of the present invention.
Figure 10:
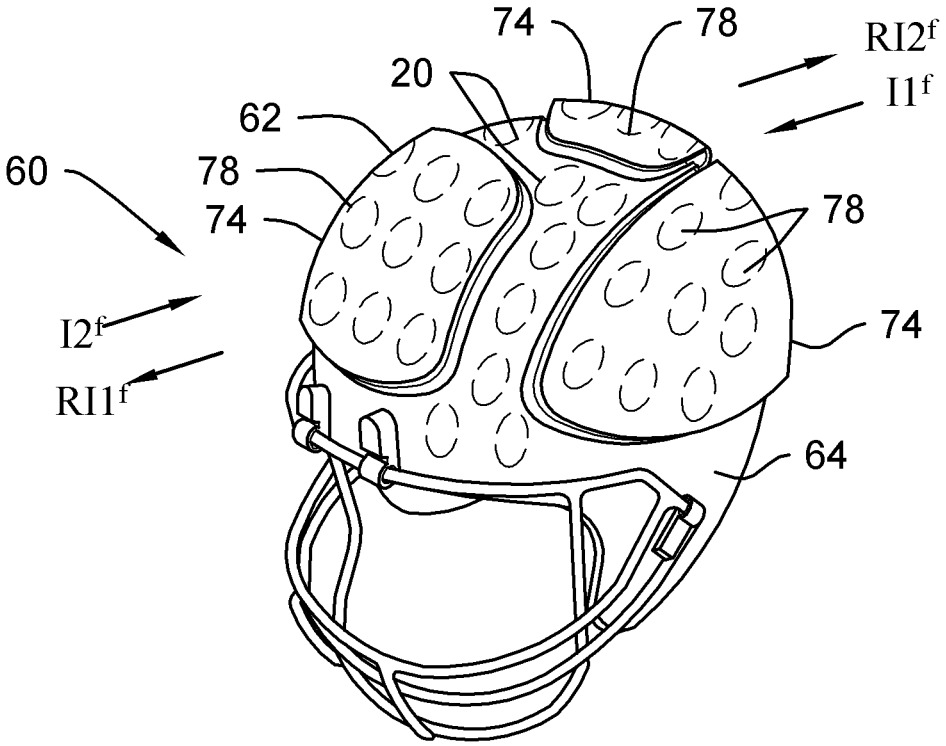
FIG. 10 is a perspective view of the magnetic segmented sport equipment with the sections in a deployed position.

Referring to FIGS. 9 and 10, an alternate embodiment of the magnetically repulsive sport equipment is herewith described as a magnetic segmented sport equipment and is shown and generally designated by the reference numeral 60.

More particularly, the magnetic segmented sport equipment 60 can be any sport equipment that receives impact, such as but not limited to, helmets, shoulder protectors, elbow protectors, knee protectors, thigh protectors, hip protectors, shin protectors, wrist protectors, arm protectors, chest protectors, spine protectors, neck protectors, face protectors, torso protectors, and abdomen protectors.

Alternatively, the magnetic segmented sport equipment 60 can also be sport equipment worn by a player and in combination with sport paraphernalia containing the magnetically repulsive sport equipment, such as but not limited to, baseballs, softballs, bats, hockey pucks, hockey sticks, footballs or polo mallets. The present application will describe, as an example, an embodiment of the present invention as associated with a football helmet. However, it can be appreciated that the present invention can be associated with any impact protection equipment. Thus the following exemplary description does not limit the scope of the present invention.

For exemplary purposes only, the magnetic segmented sport equipment 60 can be a helmet 62 that has an outer shell 64, an inner shell or liner assembly 16, multiple magnetic elements 20 associated with the outer shell 64, inner shell 16 or an area in between the outer and inner shells, a plurality of deployable segments or panels 74, and multiple panel magnetic elements 78 associated with each panel 74.

Figure 11:
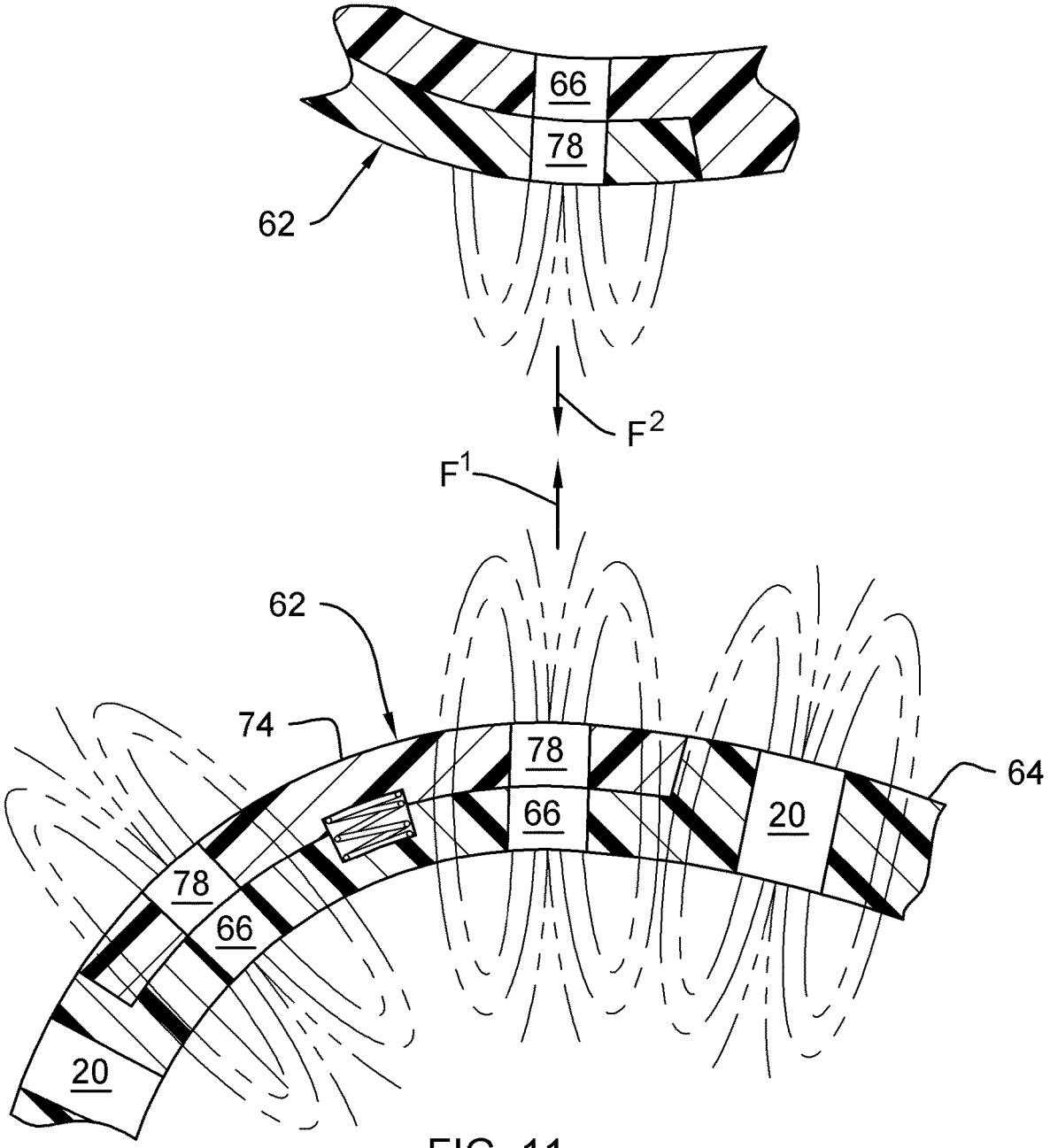
FIG. 11 is a cross-sectional view of a portion of the magnetic segmented sport equipment of the present invention with magnetic field lines and force vector lines for a helmet to helmet impact.

The magnetic elements 20 are illustrated in the outer shell 64 for exemplary purposes only. The magnetic elements 20 can be associated with an entire or partial surface of the helmet, and can be any of the above described magnetic elements in any of the above embodiments. The magnetic elements 20 are orientated so that each magnetic element 20 has the same pole facing away from the helmet 62. When a second helmet 62 having the same magnetic elements in the same orientation of the first helmet 62 impacts the first helmet 62, the repulsive force $F^1$ and $F^2$ produced between the similarly poled magnetic elements 78 of the impacting helmets reduces the impact force or deflects the impact, as best illustrated in FIG. 11. Thus reducing the impact force felt by persons wearing the helmets, and reduces the potential of head or neck injury.

The multiple deployable segments or panels 74 are positioned in predetermined location on the exterior of the outer shell 64. The panels 74 can be any shape or configuration, and can be made of the same or different material that of the outer shell 64. The panels 74 are received in recesses defined in the outer shell 64 so as to have an exterior surface of the panels 74 flush with an exterior surface of the outer shell 64. The panel magnetic elements 78 can be associated with an entire or partial surface of the panel 74. The panel magnetic elements 78 have the same orientation as the magnetic elements 20 of the outer shell 64. Thus creating the same proactive impact repulsion of the above-described magnetically repulsive sport equipment 10.

The panels 74 are outwardly biased, but are retained in the recesses by a retaining force. If an impact force is larger than the proactive impact repulsion force created by the magnetic elements 20 and the panel magnetic elements 78, then impact will occur at a point on the helmet 62 and thus create an impact force $I1^f$, $I2^f$. This impact will create a resultant impact force $RI1^f$, $RI2^f$ on the opposite side of the helmet 62. If this resultant impact force is larger than the retaining force, then that corresponding panel 74 will deploy due to the biasing force. The deployed panel 74, while in the deployed position, will absorb a secondary impact $SI^f$ thereby further reducing impact to the wearers head. The secondary impact can be but not limited to, impact from the helmet 62 hitting the ground or other object, or impact from another player.

For example, if a helmet to helmet impact $I1^f$ occurs at a backside of the helmet, this would produce a resultant impact force $RI1^f$ at the opposite front side of the helmet 62. This is true by the conservation of momentum wherein the total momentum is constant. This fact is implied by Newton's laws of motion, specifically to Newton's third law, wherein the forces between them are equal and opposite. Since the helmet 62 and the proactive impact repulsion produced by the magnetic elements 20, 78 would reduce the impact force $I1^f$, consequently a net impact force would thus create a resultant force that is equal to the net impact force and on the opposite side of impact.

As best illustrated in FIG. 10, when the helmet 62 encounters an impact force $I1^f$, $I2^f$ the resultant impact force $RI1^f$, $RI2^f$ traveling through and out from an opposite side of the impact force would automatically deploy the segment or panels 74 closest to the resultant impact force $RI1^f$, $RI2^f$. This creates a deployed shock absorbing panel 74 that will reduce any secondary impact $SI^f$ on the areas of the helmet 62 associated with the deploy panel(s) 74. After the secondary impact $SI^f$ has been absorbed by the deployed panel(s) 74, the secondary impact force or another external force would push the deployed panel(s) 74 back into its corresponding recess, thereby resetting the helmet 62 for additional play.

Figure 12A:
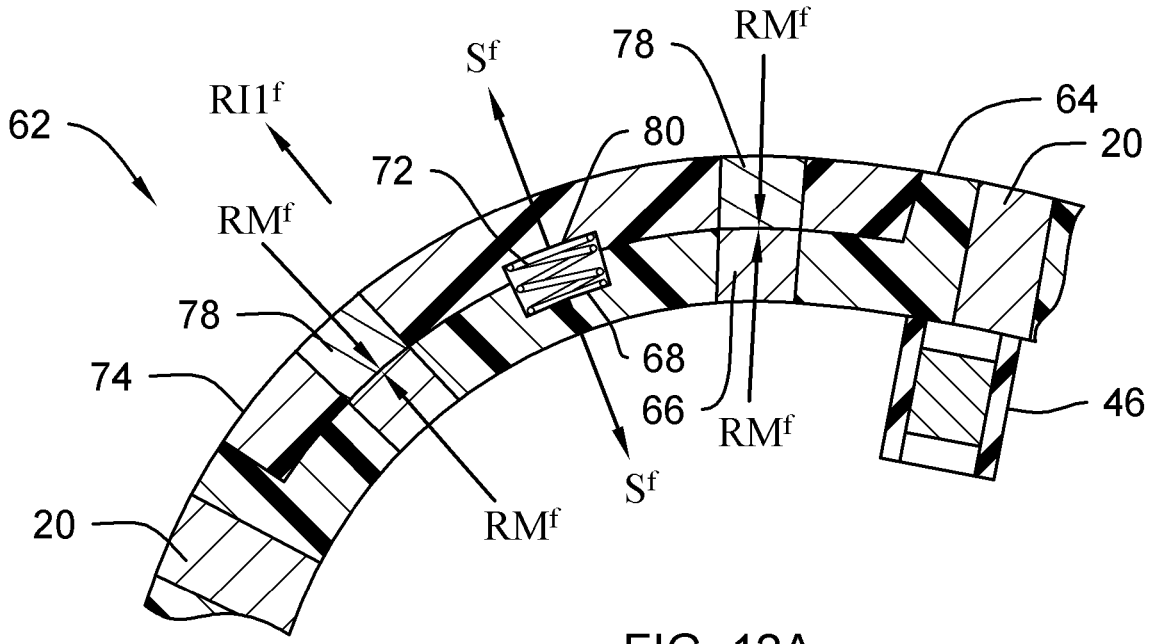
FIG. 12A is a cross-sectional view of one of the sections of the magnetic segmented sport equipment in a pre-deployed position taken along line 12A-12A in FIG. 9.
Figure 12B:
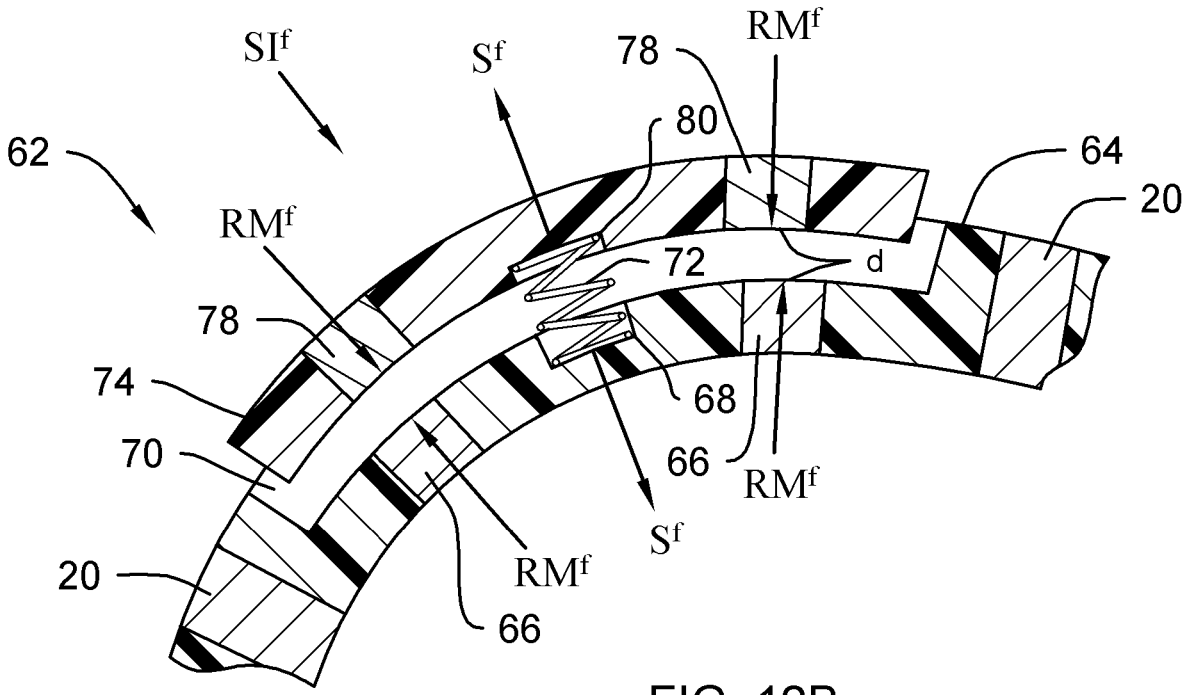
FIG. 12B is a cross-sectional view of the section in FIG. 12A in a deployed position.

Referring to FIGS. 12A and 12B, the outer shell 64 and one panel 74 are illustrated in the non-deployed and deployed states, but it is appreciated that that the following example is descriptive for any of the panels 74 in relationship with an impact and resultant force associated therewith.

The outer shell 64 includes the plurality of magnetic elements 20, as per any of the above-described embodiments, and/or may include the impact absorbing member 46, and/or may also be placed between the outer and inner shells.

The outer shell 64 further includes a recess 70 configured to receive at least one of the panels 74. The recess 70 includes a plurality of retaining magnetic elements 66 that are positioned in the outer shell 64 so that a pole of the retaining magnetic elements 66 is in magnetic force communication with the recess 70. The orientation of the retaining magnetic elements 66 is the same as that of the magnetic elements 20 and the panel magnetic elements 78.

A notch 68 is defined in the outer shell 64 that is in communication with the recess. The notch 68 is configured to receive and retain an end or portion of a biasing element 72, such as but not limited to, a torsion spring, a compression spring, a leaf spring, an inflatable bladder, a fluid filled chamber, a bellows or mutually repulsive magnets.

The panel 74 includes a shape or profile similar to that of the outer shell 64, thereby providing a flush exterior surface when the panel 74 is received in the recess 70. The panel magnetic elements 78 are arranged throughout the panel 74, and have an orientation similar to that of the magnetic elements 20 and the retaining magnetic elements 66. The panel magnetic elements 78 are also arranged so that each panel magnetic element 78 is aligned with a corresponding retaining magnetic elements 66 when in a non-deployed state, as best illustrated in FIG. 12A.

Sidewalls in the outer shell 64 that define the sides of the recess 70 also assist in guiding the panel 74 during its travel within the recess 70. The sidewalls that define the recess 70 may be angled, and sidewalls of the panel 74 may have a corresponding angle. It can be appreciated that additional retaining magnetic elements may be located in the recess sidewalls, which are aligned with corresponding panel magnetic elements located in a sidewall of the panel 74, when the panel is received in the recess. These additional retaining and panel magnetic elements can be used for additional retention control of the panel in the recess when their poles facing each other are opposite, or for creating a magnetic guide bearing when their poles facing each other are the same.

The panel 74 also includes a panel notch 80 defined in an interior surface facing the recess 70. The panel notch 80 is configured to receive and retain a second end or portion of the biasing element 72, and is arranged to align with the notch 68 when in the non-deployed and/or deployed states. The biasing element 72 is configured or selected to create a spring force $S^f$ that pushes against the panel 74.

With all the magnetic elements 20, 66, 78 having the same pole orientation in relationship with the outer shell 64, then consequently the panel magnetic elements 78 have an interior facing pole opposite of that of the retaining magnetic elements 66. This creates an attractive magnetic force or retaining magnetic force $RM^f$ between the retaining magnetic element 66 of the outer shell 64 and the panel magnetic elements 78 of the panel 74.

The retaining and panel magnetic elements 66, 78 are configured or selected so as to have a retaining magnetic force $RM^f$ that is larger than the spring force $S^f$ at a predetermined distance d between the retaining and panel magnetic elements 66, 78. It is known to one skilled in the art that the magnetic force between two opposite pole magnets decreases in relation to the distance between the magnets. This phenomenon is characterized by Equation 8.

$$F = \frac{M1 \times M2}{d^2} \qquad \text{Equation 8}$$

Figure 15:
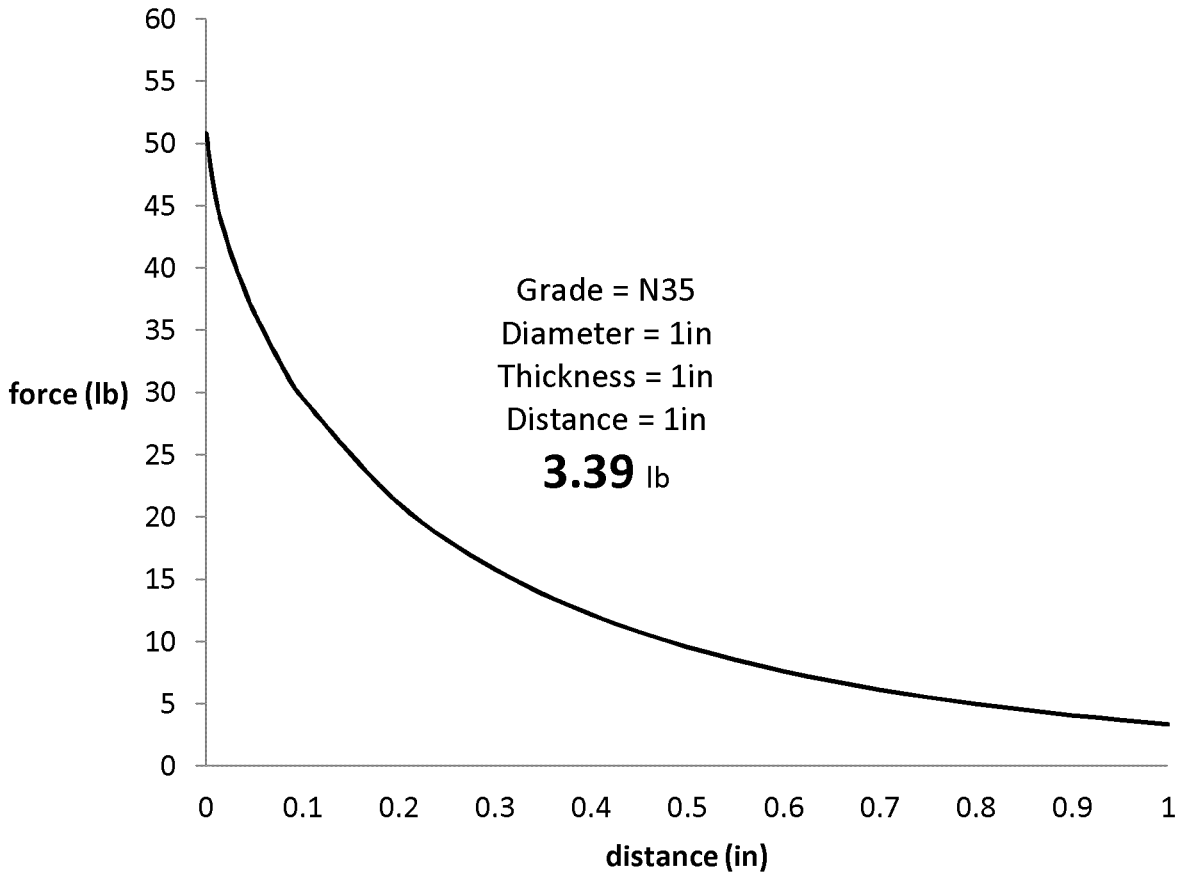
FIG. 15 is a graphical view of Table 1.

The above phenomenon associated with Equation 8 is further illustrated in FIG. 15 as Table 1, which is a graphical representation of the magnetic attraction force (retaining magnetic force $RM^f$) for a grade N35 Neodymium magnet having a diameter of 1 inch, a thickness of 1 inch and a maximum distance between two N35 magnets of 1 inch. Table 1 is exemplary of one type of magnet since all magnets contain this characteristic, and is not to limit the material or dimensions of the magnetic elements of the present invention.

One skilled in the art can conclude that the retaining magnetic force $RM^f$ that holds the panel 74 in the recess 70, incrementally or exponentially decreases as the distance d between the retaining and panel magnetic elements 66, 78 increases.

Thus it can be appreciated that the panel 74 will be retained in the recess 70 so long as the retaining magnetic force $RM^f$ is larger than the spring force $S^f$, until an external force is applied in a direction substantially opposite to the retaining magnetic force $RM^f$ or substantially in the same direction of the spring force $S^f$. In keeping within the scope of the present example, the external force could be the resultant impact force $RI1^f$ created by an impact force $I1^f$ on the opposite side of the helmet 62. When the resultant impact force $RI1^f$ and the spring force $S^f$ are substantially inline, their force vectors will combine to create a net resultant force that is greater than the retaining magnetic force $RM^f$, thus releasing the panel 74 from its magnetic retaining hold and deploying it out from the recess 70, as best illustrated in FIG. 12B.

The panel 74 would separate from the retaining magnetic elements 66 because the net resultant force is greater than the retaining magnetic force $RM^f$, thus creating a gap or distance d between the retaining and panel magnetic elements 66, 78. With each incremental increase in distance d, the retaining magnetic force $RM^f$ decreases, thus decreasing the retention hold on the panel 74 and further allowing the panel to be deployed by way of the spring force $S^f$.

In this deployed state, the panel 74 is extending so that the distance d between the retaining and panel magnetic elements 66, 78 is enough to decrease the retaining magnetic force $RM^f$ so as to be less than the spring force $S^f$. Thus keeping the panel 74 deployed until a secondary impact force $SI^f$ is applied to the panel 74. Some of the secondary impact force $SI^f$ on the panel 74 will be absorbed by the spring force $S^f$ of the biasing element 72, thus decreasing any secondary impact on the wearers head and thereby reducing potential injury to the wearer or player.

The panel 74 is returned to the non-deployed state by the secondary impact force $SI^f$ or an additional secondary impact force, so long as the secondary impact force $SI^f$ is greater than the spring force $S^f$. The panel 74 will then be retained in the recess 70 when the distance d between the retaining and panel magnetic elements 66, 78 is small enough to create a retaining magnetic force $RM^f$ greater than the spring force $S^f$. After which, the panel 74 is reset and ready for additional play.

The above retention and deployment characteristics can be adjusted or designed by changing the material and/or size of the magnetic elements 20, 66, 78, and/or by changing the type and strength of the biasing element 72. This would give the wearer the ability to adjust when or how much impact force is needed to deploy the panel 74, or how much secondary impact shock absorption is created by the biasing element 72.

Figure 13A:
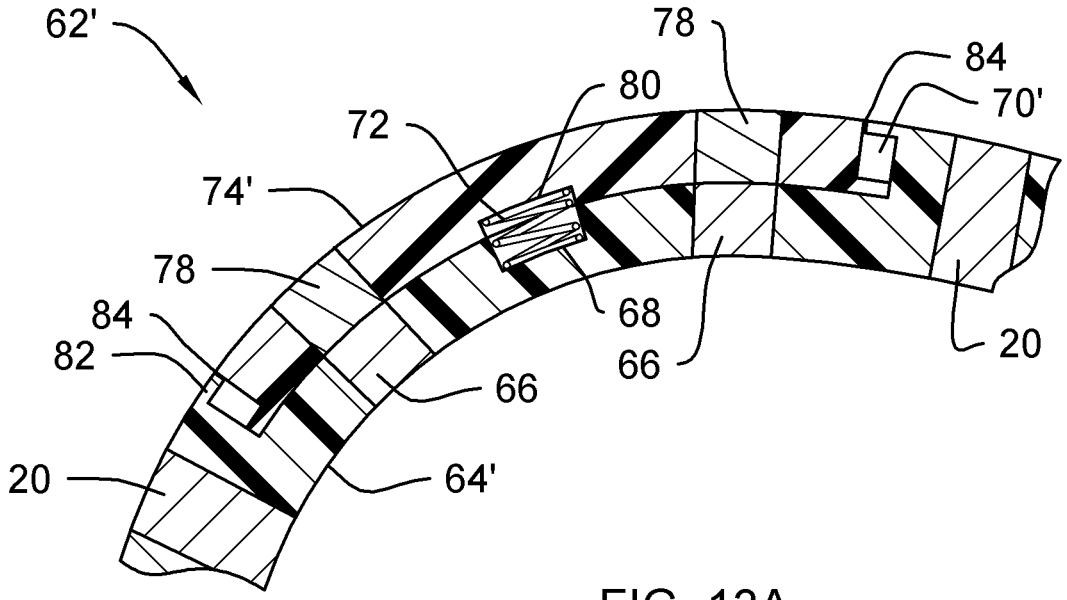
FIG. 13A is a cross-sectional view of a first alternate embodiment magnetic segmented sport equipment with one of the sections in a pre-deployed position.
Figure 13B:
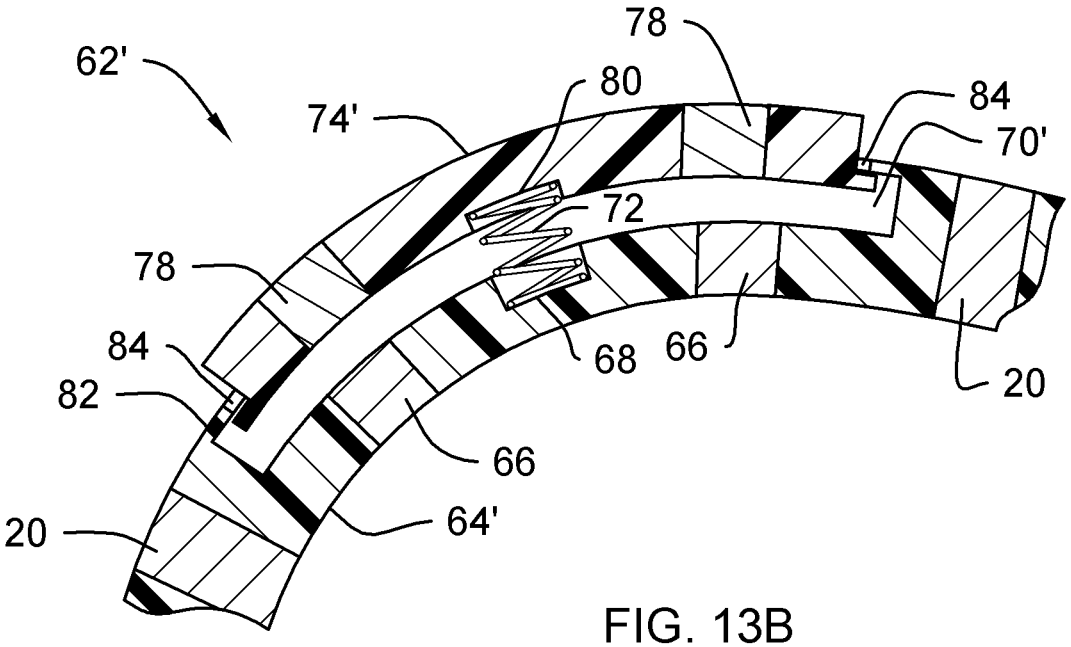
FIG. 13B is a cross-sectional view of the section in FIG. 13A in a deployed position.

As best illustrated in FIGS. 13A and 13B, an alternate embodiment helmet 62' including an alternate embodiment outer shell 64' and panel 74' will be described. The outer shell 64' includes the plurality of magnetic elements 20 as per any of the above-described embodiments, and/or may include the impact absorbing member (not shown), and/or may also be placed between the outer shell 64' and inner shell (not shown).

The outer shell 64' further includes a recess 70', and a lip 82 extending into the recess 70' from an upper side of the outer shell 64'. The lip 82 defines an opening 84 in communication with the recess 70', and the opening is configured to receive therethrough at least one of or a portion of the panels 74'. The recess 70' includes a plurality of retaining magnetic elements 66 that are positioned in the outer shell 64' so that a pole of the retaining magnetic elements 66 is in magnetic force communication with the recess 70'. The orientation of the retaining magnetic elements 66 is the same as that of the magnetic elements 20 and panel magnetic elements 78. The notch 68 is defined in the outer shell 64' that is in communication with the recess 70'. The notch 68 is configured to receive and retain an end or portion of the biasing element 72.

The panel 74' includes a shape or profile similar to that of the outer shell 64', thereby providing a flush exterior surface when the panel 74' is received in the recess 70'. The panel magnetic elements 78 are arranged throughout the panel 74', and have an orientation similar to that of the magnetic elements 20 and the retaining magnetic elements 66. The panel magnetic elements 78 are also arranged so as each panel magnetic element 78 is aligned with a corresponding retaining magnetic elements 66 when in a non-deployed state, as best illustrated in FIG. 13A.

The panel 74' also includes the panel notch 80 defined in an interior surface facing the recess 70'. The panel notch 80 is configured to receive and retain a second end or portion of the biasing element 72, and is arranged to align with the notch 68 when in the non-deployed and/or deployed states. The biasing element 72 is configured or selected to create a spring force $S^{f}$ that pushes against the panel 74'.

The bottom side of the panel 74' has a flange 86 extending out from a peripheral edge, and is sized so as to be received in the recess 70'. The lip 82 of the outer shell 64' and the flange 86 of the panel 74' overlap so that flange 86 is able to travel only in the recess, thereby creating a travel stop for the panel 74', as best illustrated in FIG. 13B.

Sidewalls in the outer shell 64' that define the sides of the recess 70' also assist in guiding the panel 74' during its travel within the recess 70'. It can be appreciated that additional retaining magnetic elements may be located in the recess sidewalls, which are aligned with corresponding panel magnetic elements located in a sidewall of the panel 74', when the panel is received in the recess 70'. These additional retaining and panel magnetic elements can be used for additional retention control of the panel in the recess when their poles facing each other are opposite, or for creating a magnetic guide bearing when their poles facing each other are the same.

It can further be appreciated that additional retaining magnetic elements may be located in a bottom surface of the lip 82 and/or in a bottom side of the recess 70' each of which being in communication with the recess 70'. Additional panel magnetic elements can be located in a top side and/or bottom side of the flange 86 of the panel 74', so as to correspond with the additional retaining magnetic elements in the bottom side of the lip and/or the recess. These additional retaining and panel flange magnetic elements can be used for additional retention control of the panel in the recess when their poles facing each other are opposite, or for creating a magnetic guide bearing when their poles facing each other are the same.

Even still further, an edge of the flange 86 can include a seal which contacts the recess sidewall throughout its entire travel, and an edge of the lip 82 can include a seal which contacts a sidewall of the panel 70' throughout its entire travel. This double seal arrangement through the panel's entire travel creates a sealed chamber between the lip 82 and the flange 86. This chamber can be filled with a gas or a fluid, so as to provide additional secondary shock absorption. The edge flange seal can be configured to allow a predetermined amount of gas or fluid to pass therearound to the opposite of the flange, so as to control the shock absorbing characteristics of the gas or fluid.

Figure 14A:
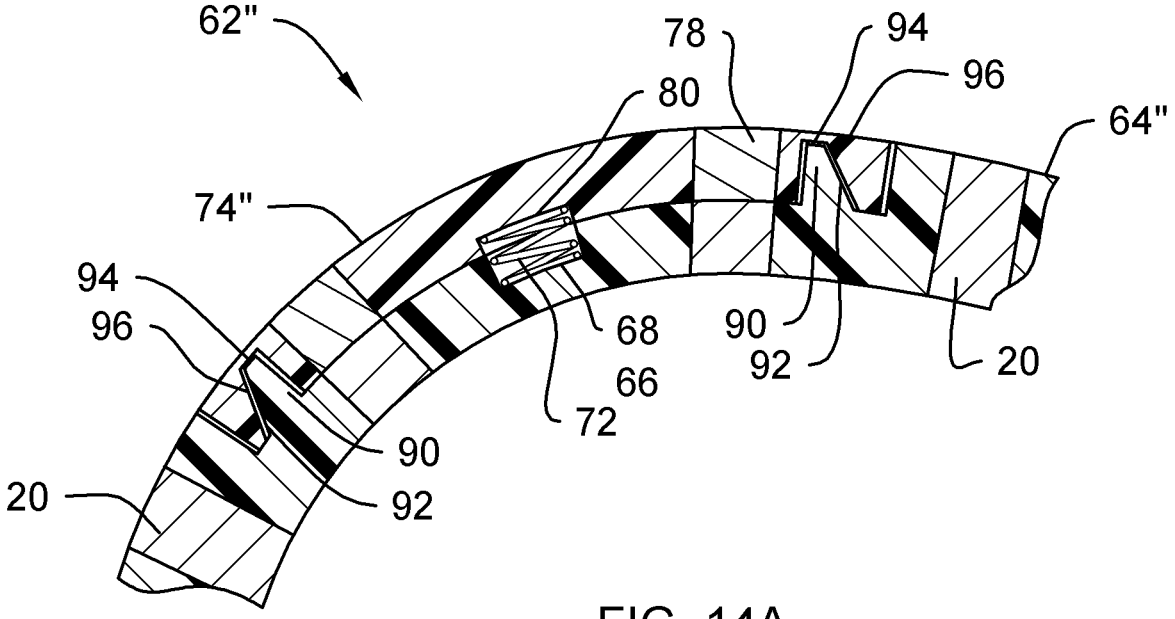
FIG. 14A is a cross-sectional view of a second alternate embodiment magnetic segmented sport equipment with one of the sections in a pre-deployed position.
Figure 14B:
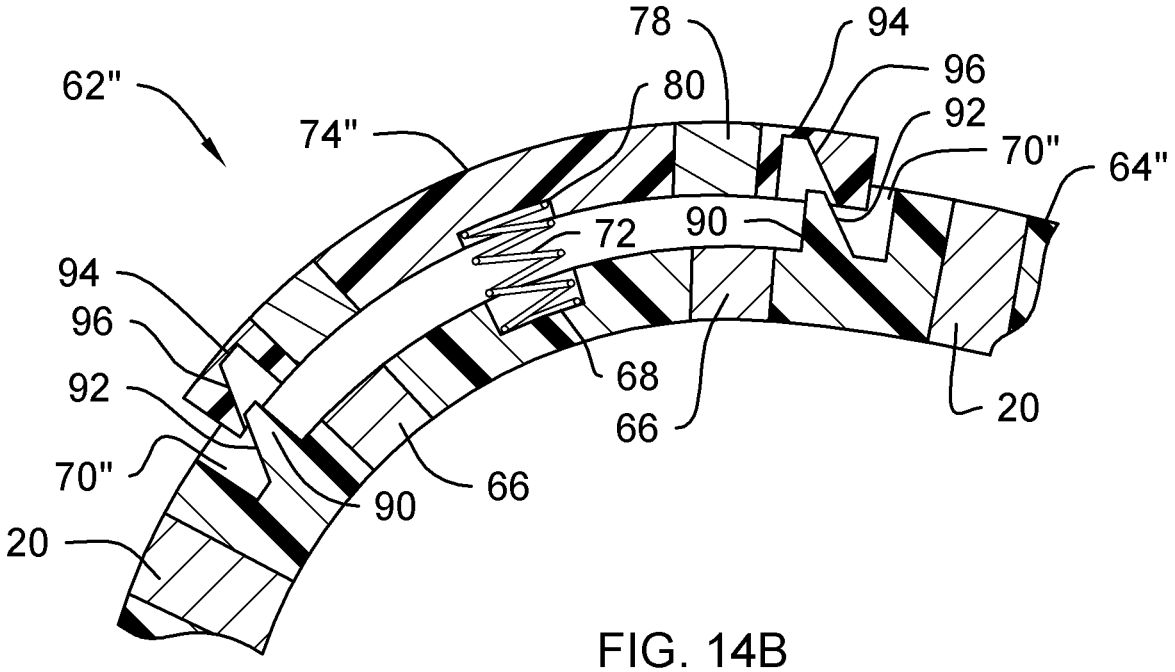
FIG. 14B is a cross-sectional view of the section in FIG. 14A in a deployed position.

As best illustrated in FIGS. 14A and 14B, an alternate embodiment helmet 62" including an alternate embodiment outer shell 64" and panel 74" will be described. The outer shell 64" includes the plurality of magnetic elements 20 as per any of the above-described embodiments, and/or may include the impact absorbing member (not shown), and/or may also be placed between the outer and inner shells. The outer shell 64" further includes a recess 70", and a guide protrusion or detent 90 extending into the recess 70" from a bottom side of the recess 70".

The recess 70" includes the plurality of retaining magnetic elements 66 that are positioned in the outer shell 64" so that a pole of the retaining magnetic elements 66 is in magnetic force communication with the recess 70". The orientation of the retaining magnetic elements 66 is the same as that of the magnetic elements 20 and panel magnetic elements 78.

The notch 68 is defined in the outer shell 64" so as to be in communication with the recess 70". The notch 68 is configured to receive and retain an end or portion of the biasing element 72.

The guide detent 90 is concentric or offset from sidewalls of the recess 70", thereby creating an open area or gap between the guide detent 90 and the sidewalls. The guide detent 90 has an angled side 92 facing the sidewalls of the recess 70". The angled side 92 is angled away from the sidewalls of the recess 70".

The panel 74" includes a shape or profile similar to that of the outer shell 64", thereby providing a flush exterior surface when the panel 74" is received in the recess 70". The panel magnetic elements 78 are arranged throughout the panel 74", and have an orientation similar to that of the magnetic elements 20 and the retaining magnetic elements 66. The panel magnetic elements 78 are also arranged so as each panel magnetic element 78 is aligned with a corresponding retaining magnetic elements 66 when in a non-deployed state, as best illustrated in FIG. 14A.

The panel 74" includes the panel notch 80 defined in an interior surface facing the recess 70". The panel notch 80 is configured to receive and retain a second end or portion of the biasing element 72, and is arranged on the interior surface of the panel 74" so as to align with the notch 68 when in the non-deployed and/or deployed states. The biasing element 72 is configured or selected to create a spring force $S^{f}$ that pushes against the panel 74".

The panel 74" also includes a groove 94 defined in a bottom side of the panel 74" adjacent or offset from a bottom peripheral edge. The groove 94 has a shape that corresponds with the guide detent 90, and is defined in the panel 74" so as to receive the guide detent 90 when in at least the non-deployed state. The groove 94 includes an angled side 96 having an angle that corresponds with the angle of the angled side 92 of the guide detent 90, as best illustrated in FIG. 14B. It can be appreciated that any geometric shape that guides the travel of the panel 74" while allowing the panel 74" to be retracted back into the recess 70" can be used in place of the above-described.

Sidewalls in the outer shell 64" that define the sides of the recess 70" may also assist in guiding the panel 74" during its travel within the recess 70". It can be appreciated that additional retaining magnetic elements may be located in the recess sidewalls or in the guide detent 90, which are aligned with corresponding panel magnetic elements located in a sidewall of the panel 74" or in the groove 94, when the panel is received in the recess. These additional retaining and panel magnetic elements can be used for additional retention control of the panel in the recess when their poles facing each other are opposite, or for creating a magnetic guide bearing when their poles facing each other are the same.

It can be appreciated that the guide detent 90 and groove 94 configuration can be any geometry shape, such as but not limited to, spherical, elliptical, rectangular, polygonal, triangular or cylindrical. The guide detent 90 and groove 94 configuration can also be in the form of joinery, such as but not limited to, a tongue and groove, dove tail, bridal, butt, dado or mortise and tenon.

Any of the above-described magnetic segmented sport equipment 60 can be equipped with an automatic trigger mechanism that would mechanically retain the panel in the recess, and then automatically release the panel upon an impact on the helmet 62.

Figure 16:
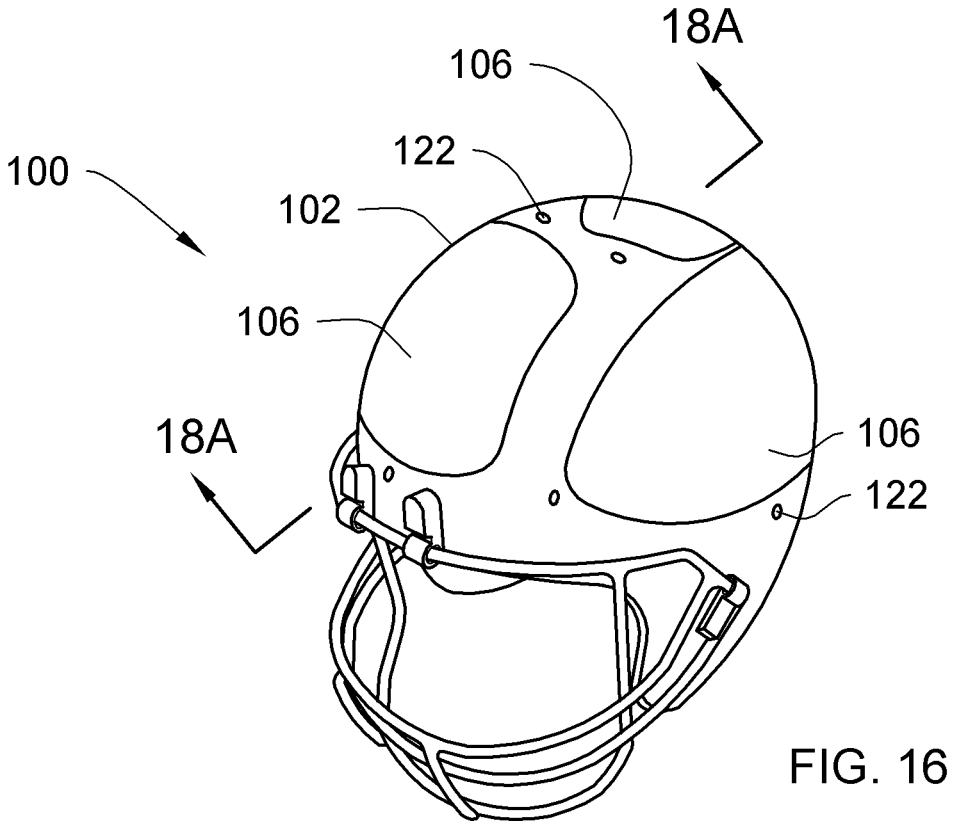
FIG. 16 is a perspective view of an embodiment of the deployable segmented sport equipment in a pre-deployed position, constructed in accordance with the principles of the present invention.
Figure 17:
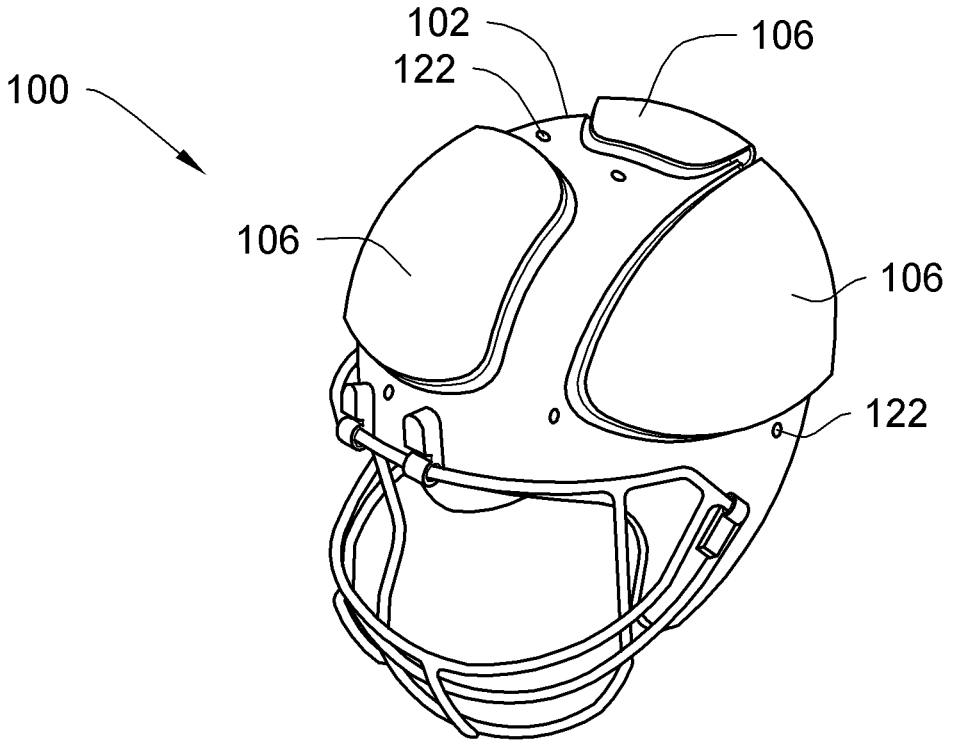
FIG. 17 is a perspective view of the deployable segmented sport equipment with the panels in a deployed position.

Referring to FIGS. 16 and 17, an embodiment of the present invention is a deployable segmented sport equipment 100 is herewith described and equipped with an automatic trigger mechanism that would retain a panel in a recess, and then automatically deploy the panel prior to impact with a foreign object.

More particularly, the deployable segmented sport equipment 100 can be any sport equipment worn by a user that receives impact, such as but not limited to, helmets, shoulder protectors, elbow protectors, knee protectors, thigh protectors, hip protectors, shin protectors, wrist protectors, arm protectors, chest protectors, spine protectors, neck protectors, face protectors, torso protectors, and abdomen protectors.

The present deployable segmented sport equipment 100 will describe, as an example only, as associated with a football helmet. However, it can be appreciated that the deployable segmented sport equipment 100 can be associated with any impact protection equipment. Thus the following exemplary description does not limit the scope of the deployable segmented sport equipment 100.

For exemplary purposes only, the deployable segmented sport equipment 100 can be a helmet 102 that has at least a body or shell 104, one or more plurality of deployable segments or panels 106, and one or more proximity sensing devices 122.

The deployable segments or panels 106 are positioned in predetermined location on the exterior of the shell 104. The panels 106 can be any shape or configuration, and can be made of the same or different material that of the shell 104. Each of the panels 106 are receivable in a corresponding recess 112 defined in the shell 104 so as to have an exterior surface of the panels 106 flush with an exterior surface of the shell 104, when the panels 106 are received in their recess 112.

As illustrated in FIG. 17, the panels 106 are able to deploy a predetermined distance from their corresponding recess 112, prior to contact with a foreign object.

With reference to FIGS. 13A and 13B, the shell 104 can include a lip 114 extending into each recess 112 from an upper side of the shell 104. The lip 114 can be a continuous flange extending from a perimeter which defines the recess 112, or can be a plurality of lips in spaced apart relationship with each other. The lip 114 defines an opening 116 in communication with the recess 112, and the opening 116 can have a configuration capable of receiving therethrough at least one of or a portion of the panels 106.

The panels 106 can include a shape or profile similar to that of the shell 104, thereby providing a flush exterior surface when the panel 106 is received in the recess 112. Each panel 106 can include at least one panel magnetic element 110 located on a side in communication with the recess 112. The panel magnetic element 110 can be, but not limited to, any ferromagnetic materials, paramagnetic materials or diamagnetic materials. In one embodiment, the panel magnetic element 110 is a magnetic having at least one pole that can be acted upon by a retraction or repulsion force.

It can be appreciated that the panel magnetic element 110 can provide a repulsion force against another magnetic element not association with the deployable segmented sport equipment 100, thereby reducing or deflecting a portion of an impact force prior to contact, as described above.

Figure 18A:
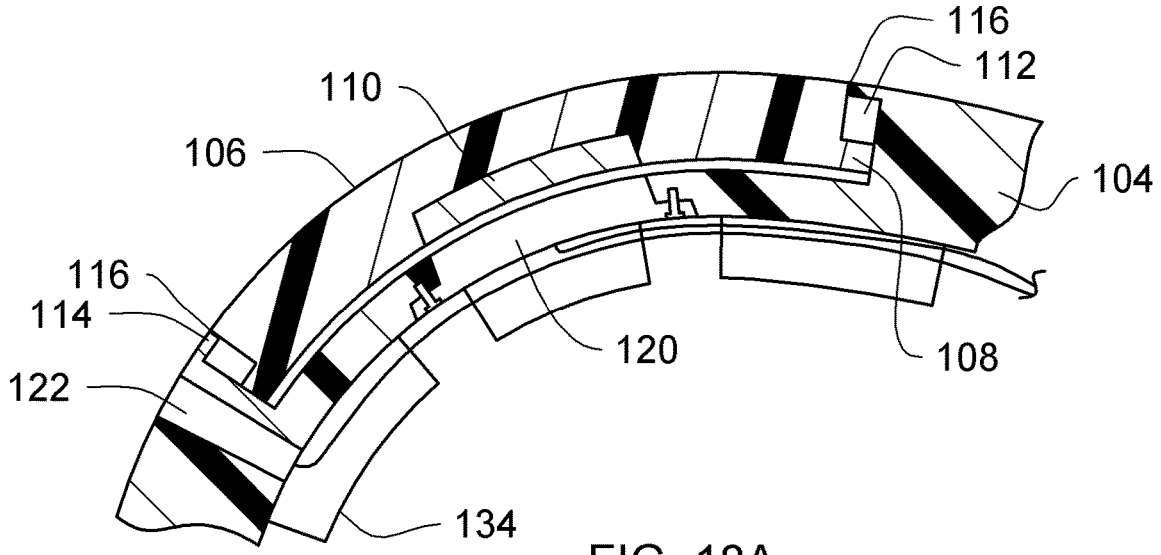
FIG. 18A is a cross-sectional view of the panel of the deployable segmented sport equipment in a pre-deployed position, taken along line 18A-18A in FIG. 16.
Figure 18B:
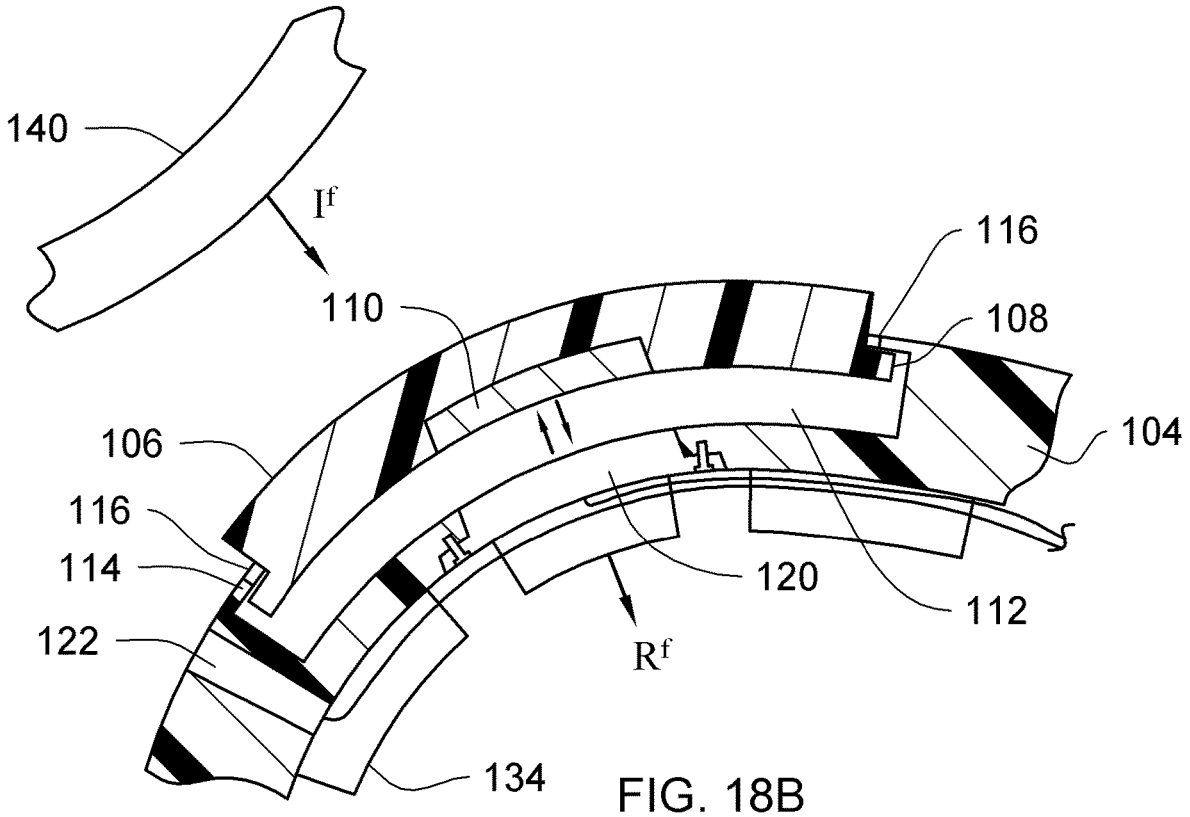
FIG. 18B is a cross-sectional view of the panel in FIG. 18A in a deployed position.

The bottom side of the panel 106 can include a flange 108 extending out from a peripheral edge, and is sized so as to be received within the recess 112. The lip 114 of the shell 104 and the flange 108 of the panel 106 overlap so that flange 108 is able to travel only in the recess 112, thereby creating a travel stop for the panel 106, as best illustrated in FIG. 18B.

It can be appreciated that the lip 114 and flange 108 arrangement can be angled sides. With the lip 114 being a perimeter of the recess 112 with angles that converge toward each other in a direct away from the shell 104. The flange 108 can be a perimeter of the panel 106 with angles that diverge from each other toward an interior of the shell 104.

Each recess 112 can include at least one opening having a configuration capable of receiving a controllable magnetic element such as, but not limited to, an electromagnetic element 120. The electromagnetic element 120 can include features that enable the electromagnetic element 120 to be removably mounted to the shell 104 so as to be adjacent to or in communication with the recess 112. It can be appreciated that the electromagnetic element 120 can be attached to the shell 104 by way of, but not limited to, screws, fasteners, adhesives, clamps, clips, etc. The electromagnetic element 120 has a configuration capable of producing a magnetic field in a direction toward the panel magnetic element 110.

Sidewalls in the shell 104 that define the sides of the recess 112 can have a configuration capable of assisting in guiding the panel 106 during its travel within the recess 112. It can be appreciated that additional retaining magnetic elements may be located in the recess sidewalls, which are aligned with corresponding panel magnetic elements located in a sidewall of the panel 106, when the panel is received in the recess 112. These additional retaining and panel magnetic elements can be used for additional retention control of the panel in the recess when their poles facing each other are opposite, or for creating a magnetic guide bearing when their poles facing each other are the same.

It can further be appreciated that additional retaining magnetic elements may be located in a bottom surface of the lip 114 and/or in a bottom side of the recess 112 each of which being in communication with the recess 112. Additional panel magnetic elements can be located in a top side and/or bottom side of the flange 108 of the panel 106, so as to correspond with the additional retaining magnetic elements in the bottom side of the lip 114 and/or the recess 112. These additional retaining and panel flange magnetic elements can be used for additional retention control of the panel in the recess when their poles facing each other are opposite, or for creating a magnetic guide bearing when their poles facing each other are the same.

Even still further, an edge of the flange 108 can include a seal which contacts the recess sidewall throughout its entire travel, and an edge of the lip 114 can include a seal which contacts a sidewall of the panel 106 throughout its entire travel. This double seal arrangement through the panel's entire travel creates a sealed chamber between the lip 114 and the flange 108. This chamber can be filled with a gas or a fluid, so as to provide additional secondary shock absorption. The edge flange seal can be configured to allow a predetermined amount of gas or fluid to pass therearound to the opposite of the flange, so as to control the shock absorbing characteristics of the gas or fluid.

The shell 104 can include at least one proximity sensor 122 located near each panel 106. The proximity sensor 122 can be any type of sensor that can detect the proximity of an object 140 without any physical contact. Such a proximity sensor 122 can be based on, but not limited to, capacitive, capacitive displacement sensor, doppler effect, eddy-current, inductive, laser rangefinder, magnetic, passive optical, charge-coupled devices, passive thermal infrared, photocell, radar, reflection of ionising radiation, sonar, ultrasonic sensor, fiber optics, hall effect sensor, etc.

It can be appreciated that the deployable segmented sport equipment 100 can include interior shock absorbing means such as, but not limited to, padding 134.

Figure 19A:
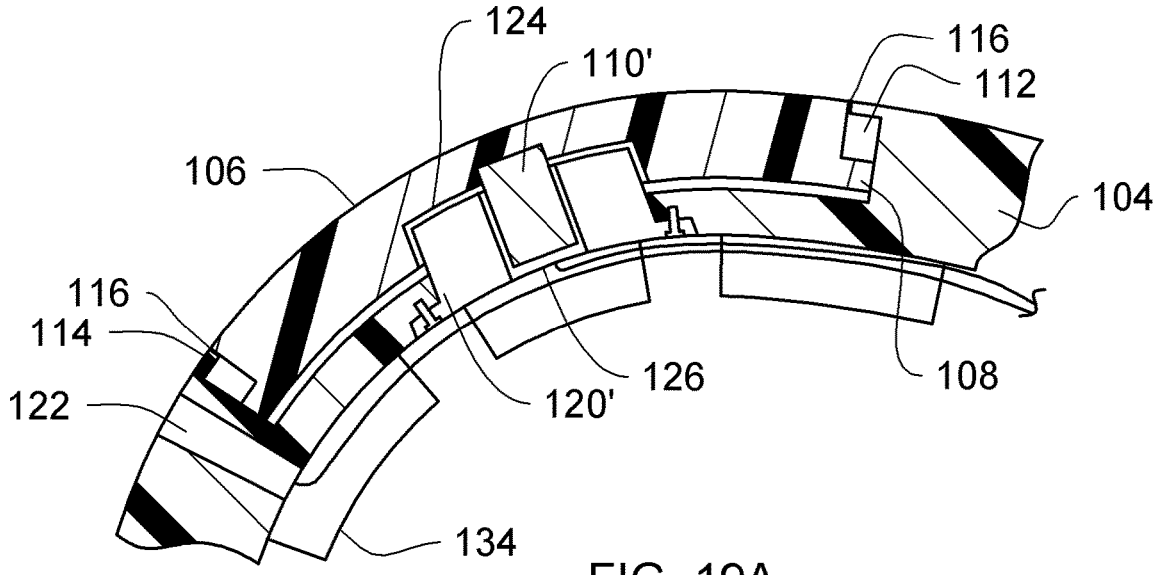
FIG. 19A is a cross-sectional view an alternate embodiment panel, panel magnetic element and electromagnetic element in a pre-deployed position.
Figure 19B:
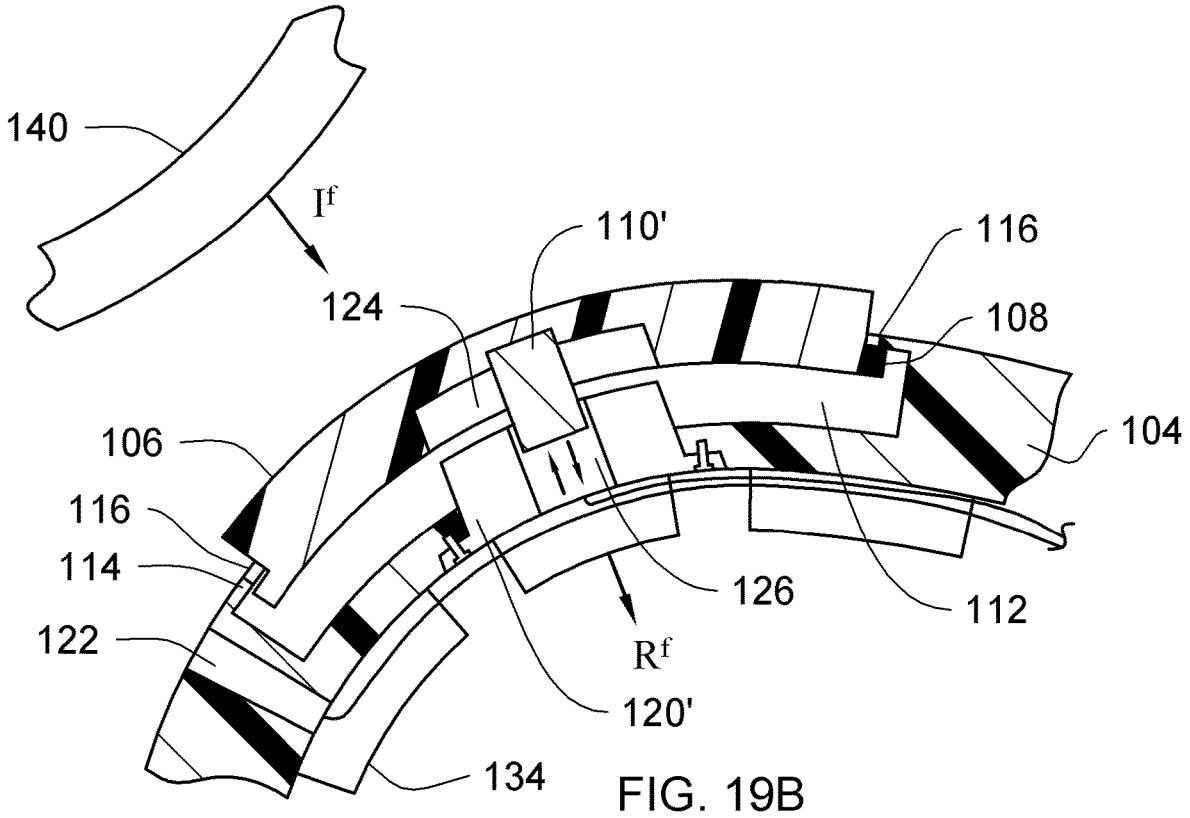
FIG. 19B is a cross-sectional view the alternate embodiment panel, panel magnetic element and electromagnetic element of FIG. 19A in a deployed position.

With reference to FIGS. 19A and 19B, each panel 106 can include a panel recess 124 located on a side in communication with the recess 112. A panel magnetic element 110' can extend out from the panel recess 124, and can be in the form of an elongated member. The panel magnetic element 110' can have an elongated shape, such as but not limited to, a rod, a shaft or a cylindrical member. In one embodiment, the panel magnetic element 110' is a metal member that can be acted upon by a retraction or repulsion force.

Each recess 112 can include at least one opening having a configuration capable of receiving an electromagnetic element 120'. The electromagnetic element 120' can be an elongated electromagnet featuring a bore 126 therein or therethrough. The bore 126 can have a configuration capable of receiving a portion of the panel magnetic element 110'. It can therefore be appreciated that the panel magnetic element 110' and the electromagnetic element 120' create a solenoid-like association. The electromagnetic element 120' has a configuration capable of producing a magnetic field in a direction toward the panel magnetic element 110' so as to attract or repel the panel magnetic element 110' so as to deploy and/or retract the panel 106.

A free end portion of the electromagnetic element 120' can be received in the panel recess 124 when the panel 106 is received in the recess 112.

Figure 20:
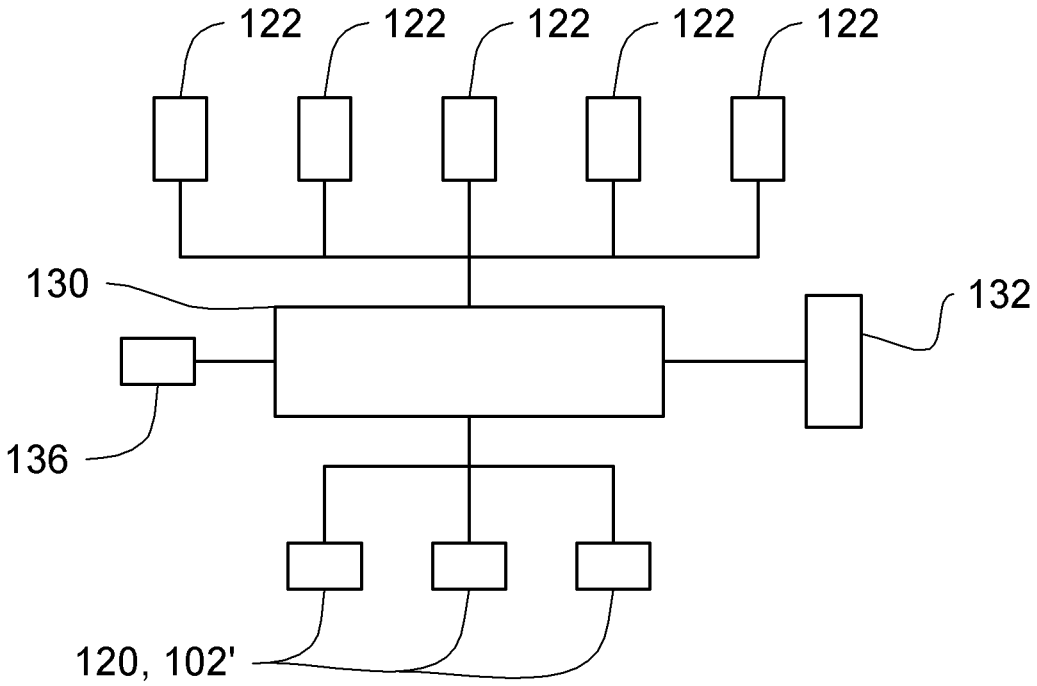
FIG. 20 is a schematic view of the electrical components of the deployable segmented sport equipment.

With reference to FIG. 20, the deployable segmented sport equipment 100 can include a controller unit 130 including electronical components capable of receiving power from a power source 132, receiving signals from each proximity sensor 122, processing the signals, and providing at least one signal to each electromagnetic element 120'. The controller unit 130 can include at least one processor, at least one memory module, a wired and/or wireless communication module, at least one bus, at least one logic control circuitry, at least one control button and/or switches 136, and at least input and/or output port.

The power source 132 can be, but not limited to at least one battery. The battery can be replaceably mountable to the deployable segmented sport equipment 100 or can be located remote of the deployable segmented sport equipment 100. It can be appreciated that the deployable segmented sport equipment 100 can include and/or be in communication with a power generation system for providing power to the electrical components or for recharging the power source 132.

In use, it can be understood that the deployable segmented sport equipment 100 can be placed on or worn by a user. When powered on, the deployable segmented sport equipment 100 each electromagnetic element 120, 120' is powered to create an attraction force against the panel magnetic element 110, 110' so as to retract the panels 106 in their corresponding recess 112. Each proximity sensor 122 will passively or actively sense the proximity of an object 140 at a distance from the shell 104.

The signals from the proximity sensors 122 are processed by the controller unit 130, and if a signal from any one of the proximity sensors 122 is below a predetermined threshold, the controller unit 130 will reverse the polarity of the electromagnetic element 120, 120' associated with that proximity sensor 122. Reversing the polarity of the electromagnetic element 120, 120' will create a repulsion force against its corresponding panel magnetic element 110, 110' so as to deploy the corresponding panel 106 prior to impact with the object 140.

With the panel 106 deployed, an impact force $I^f$ is created upon impact between the deployed panel 106 and the object 140. In this deployed state, the panel 106 is extending a travel distance of the panel 106. Upon impact, the panel 106 will travel back into the recess 112 but this travel encounters a resisting force resulting from the repulsion force provided by the electromagnetic element 120, 120'. This resisting force reduces a portion of the impact force $I^f$ to create a resultant force $R^f$. This reduced resultant force $R^f$ is then transferred toward the user, which can then be further absorbed or reduce by use of additional elements such as, but not limited to, the padding 134.

The magnitude of the resisting force against the impact force $I^f$ is controlled by the controller unit 130, and can be adjusted or changed based on the type of impact, user preference or any other conditions.

The above retention and deployment characteristics can be adjusted or designed by changing the material and/or size of the panel magnetic element 110, 110', and/or by changing the type or controlling the electromagnetic element 120, 120'.

After impact, activation of a control button 136 or a predetermined amount of time, the controller unit 130 can then reverse the polarity of the electromagnetic element 120, 120' associated with the deployed panel 106 so as to retract the panel 106 back into the recess 112.

While embodiments of the magnetic and/or deployable segmented sport equipment have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. And although reducing the impact force on sport equipment by automatically deploying impact absorbing segments has been described for exemplary purposes, it should be appreciated that the and/or deployable segmented sport equipment herein described is also suitable for reducing impact on the human body regarding other sport protection equipment, sport balls or sport pucks containing the magnetic elements in combination with deployable segments.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A deployable segmented sport equipment for reducing an impact force received by a user, said deployable segmented sport equipment comprising:

a body defining at least one recess, said body being a shell of a helmet configured to receive a head of a user;

at least one controllable magnetic element associated with said recess of said body, said controllable magnetic element having a configuration capable of producing a magnetic force selected from the group consisting of an attraction force and a repulsion force;

at least one panel movable and receivable in said recess, said panel having at least one panel magnetic element, said panel magnetic element having a configuration capable of being acted upon by said magnetic force of said controllable magnetic element; and at least one proximity sensing device having a configuration capable of sensing an object at a distance from said deployable segmented sport equipment;

wherein said deployable segmented sport equipment is worn by the user;

wherein said controllable magnetic element having a configuration capable of being operated to deploy said panel prior to impact of the object with said body.

2. The deployable segmented sport equipment of claim 1, wherein said body further comprising a lip extending into said recess.

3. The deployable segmented sport equipment of claim 2, wherein said lip defines an opening in communication with said recess, said opening having a configuration capable of receiving therethrough at least a portion of said panel.

4. The deployable segmented sport equipment of claim 3, wherein said panel further comprising a flange extending out from a peripheral edge of said panel, said flange having a configuration capable of being received within said recess.

5. The deployable segmented sport equipment of claim 4, wherein said lip and said flange having a configuration capable of overlapping each other so that said flange is able to travel in said recess while said lip creating a travel stop for said panel.

6. The deployable segmented sport equipment of claim 1 further comprising a controller unit having a configuration capable of receiving power from a power source, receiving a signal from said proximity sensing device, and providing a control signal to said controllable magnetic element.

7. The deployable segmented sport equipment of claim 6, wherein said panel further comprising at least one panel recess located on a side of said panel in communication with said recess, with said panel magnetic element extending out from said panel recess.

8. The deployable segmented sport equipment of claim 7, wherein said panel magnetic element is an elongated member.

9. The deployable segmented sport equipment of claim 8, wherein said controllable magnetic element defining a bore having a configuration capable of slidably receiving at least a portion of said panel magnetic element.

10. The deployable segmented sport equipment of claim 9, wherein said controllable magnetic element is an electromagnet controllable by said controller unit, said electromagnet has a configuration capable of producing a variable magnetic field against said panel magnetic element so as to attract or repel said panel magnetic element and thus deploy or retract said panel.

11. The deployable segmented sport equipment of claim 10, wherein said electromagnet includes a free end portion having a configuration capable of being received in said panel recess when said panel is received in said recess.

12. The deployable segmented sport equipment of claim 1, wherein said panel is a plurality of panels each being received in a corresponding recess.

13. The deployable segmented sport equipment of claim 12, wherein said proximity sensing device is a plurality of proximity sensing devices, with at least one of said plurality of proximity sensing devices being adjacent to each of said panels.

14. The deployable segmented sport equipment of claim 1, wherein said panel has an exterior surface contour that follows an exterior surface contour of an area of said shell of said helmet adjacent said panel when said panel is in a retracted position in said recess.

* * * * *